US008520040B2

(12) United States Patent
Kaechi

(10) Patent No.: US 8,520,040 B2
(45) Date of Patent: Aug. 27, 2013

(54) THERMAL PRINTER AND OVERCOAT PRINTING METHOD

(75) Inventor: Shuya Kaechi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 13/307,139

(22) Filed: Nov. 30, 2011

(65) Prior Publication Data

US 2012/0154505 A1 Jun. 21, 2012

(30) Foreign Application Priority Data

Dec. 15, 2010 (JP) ..... 2010-279864

(51) Int. Cl.
*B41J 17/00* (2006.01)

(52) U.S. Cl.
USPC ..... 347/215

(58) Field of Classification Search
USPC 347/171–176, 215, 217; 400/120.01–120.04
See application file for complete search history.

(56) References Cited

U.S. PATENT DOCUMENTS

| | | | | |
|---|---|---|---|---|
| 5,555,012 | A * | 9/1996 | Ellson et al. | 347/215 |
| 5,903,299 | A * | 5/1999 | Kawano | 347/215 |
| 6,190,066 | B1 * | 2/2001 | Ishigouoka et al. | 400/120.01 |
| 6,664,994 | B2 * | 12/2003 | Kyogoku et al. | 347/215 |
| 7,064,774 | B2 * | 6/2006 | Revelles | 347/215 |

FOREIGN PATENT DOCUMENTS

| | | |
|---|---|---|
| JP | 2001-012996 | 1/2001 |
| JP | 2002-240402 | 8/2002 |

* cited by examiner

*Primary Examiner* — Kristal Feggins
(74) *Attorney, Agent, or Firm* — Cowan, Liebowitz & Latman, P.C.

(57) ABSTRACT

A thermal printer which transfers ink to a printing medium to print an image, comprises a transfer unit configured to transfer dye ink to the printing medium to print an image, and transfer an overcoat onto the entire image to protect the image; and a control unit configured to control transfer of the overcoat by the transfer unit. The control unit forms a region where no overcoat is transferred to embed information in the overcoat, and forms, in the vicinity of the region where no overcoat is transferred, a pattern for hiding the information, to avoid visual perception of the information by a difference in gloss between the region where no overcoat is transferred and a region where the overcoat is transferred.

19 Claims, 18 Drawing Sheets

100
100

100
100

100
100

REMOVAL OF PRINTING COLOR

1300

1301

1302

1303

1304

100
100
REMOVAL OF PRINTING COLOR 100
100

BEFORE CORRECTION
1800
1801
1802
1803
1804
VISUAL IMAGE AFTER PRINTING

BEFORE CORRECTION
100
1821
1812
1822
ZERO OC
1813
1814
MAT OC
1811

AFTER CORRECTION
1801
1832
1802
P=80
P=220
1834
1804
P=80
P=20
P=10
P=0
P=220
1831
SUB SCANNING DIRECTION OF THERMAL HEAD
1803
1833

AFTER CORRECTION
ZERO OC
MAT OC
SUB SCANNING DIRECTION OF THERMAL HEAD
100
VISUAL IMAGE AFTER PRINTING

THERMAL PRINTER AND OVERCOAT PRINTING METHOD

BACKGROUND OF THE INVENTION

1. Field of the Invention

The present invention relates to a printing technique of transferring an overcoat onto a printed image in a thermal printer.

2. Description of the Related Art

Recently, a so-called home laboratory is popular to create a photograph by printing an image of image data acquired by a digital camera or image data processed by a computer onto a dedicated printing medium using a printer in the home and the like. The home laboratory often uses a thermal printer excellent in tonal expression of printing colors.

The thermal head of the thermal printer is configured by forming heaters in line (this line direction will be defined as the main scanning direction or the longitudinal direction of the thermal head).

The tonality of one pixel (one dot) is achieved by controlling the amount of dye of an ink ribbon sublimated per pixel. The dye sublimation amount is controlled by controlling energy to be applied to the heaters.

While conveying a printing medium in the printing direction in accordance with print data corresponding to image data (printing medium conveyance direction will be defined as the sub scanning direction), the heaters are selectively energized to sublimate the dye of the ink ribbon, forming pixels.

The ink ribbon is formed from Y (Yellow), M (Magenta), and C (Cyan) dye layers which give printing colors to a printing medium, and an overcoat layer (OC) which protects a printed image.

The thermal head presses the ink ribbon and printing medium to contact each other, and forms printing colors by sublimating Y, M, and C pixels by sequential scanning on the printing medium by an area corresponding to the number of pixels in the main scanning direction of the heaters×the number of pixels in the sub scanning direction. Then, the thermal head transfers an OC onto the printed image to protect the printing colors produced by the sublimated Y, M, and C.

The OC to be transferred by the thermal printer can change in thickness and surface state by controlling energy to be applied to the heaters.

Japanese Patent Laid-Open No. 2001-012996 discloses a printer apparatus which arbitrarily selects the presence/absence of gloss of the OC. The heating temperature to the OC is controlled while controlling energization to the thermal head to keep constant the amount of heat to be supplied to the OC. Changing the heating temperature to the OC changes the surface state of the OC and the degree of diffuse reflection on the OC surface. Based on this, the presence/absence of gloss of a printed material can be arbitrarily selected.

Japanese Patent Laid-Open No. 2002-240402 discloses a method of forming supplementary information about image information as a watermark character in the OC. Image information is received from a printing medium file or the like, and supplementary information about the image information is acquired. After printing the image information on a printing medium, application energy to the transfer head is controlled to change the glossiness of a film sheet. As a result, the supplementary information about the image information can be formed from a watermark character, sign, or the like on the sheet.

However, the printer apparatus in Japanese Patent Laid-Open No. 2001-012996 controls only the presence/absence of gloss of a printed material, and does not consider hiding of information on a printed material.

The method in Japanese Patent Laid-Open No. 2002-240402 forms supplementary information about image information as a watermark character on the surface of a printing medium without degrading the quality of a printed image. This method forms supplementary information about image information as the difference in glossiness on the surface of a printing medium so that the information can be visually checked. This method does not hide the information.

SUMMARY OF THE INVENTION

The present invention has been made in consideration of the aforementioned problems, and realizes an overcoat printing technique of disguising information embedded in a printed image by overcoat printing of a thermal printer so that the information is not visually perceivable.

In order to solve the aforementioned problems, the present invention provides a thermal printer which transfers ink to a printing medium to print an image, comprising: a transfer unit configured to transfer dye ink to the printing medium to print an image, and transfer an overcoat onto the entire image to protect the image; and a control unit configured to control transfer of the overcoat by the transfer unit, wherein the control unit forms a region where no overcoat is transferred to embed information in the overcoat, and forms, in the vicinity of the region where no overcoat is transferred, a pattern for hiding the information, to avoid visual perception of the information by a difference in gloss between the region where no overcoat is transferred and a region where the overcoat is transferred.

In order to solve the aforementioned problems, the present invention provides a thermal printer which transfers ink of an ink sheet to a printing medium to print an image, comprising: a transfer unit configured to transfer dye ink to the printing medium to print an image, and transfer an overcoat onto the image to protect the image; a control unit configured to control transfer of the overcoat by the transfer unit; and an input unit configured to input information, wherein the control unit forms information to be input by the input unit by forming, in the overcoat transferred onto the entire image, a non-transfer portion where no overcoat is transferred, and transfers the overcoat to form portions having different glosses at an overcoat transfer portion in the vicinity of the non-transfer portion.

In order to solve the aforementioned problems, the present invention provides a method of transferring an overcoat onto an entire image to protect the image in a thermal printer which transfers dye ink to a printing medium to print an image, the method comprising: a control step of controlling transfer of the overcoat, wherein in the control step, a region where no overcoat is transferred is formed to embed information in the overcoat, and a pattern for hiding the information is formed in the vicinity of the region where no overcoat is transferred, in order to avoid visual perception of the information by a difference in gloss between the region where no overcoat is transferred and a region where the overcoat is transferred.

In order to solve the aforementioned problems, the present invention provides a method of transferring an overcoat onto an image to protect the image in a thermal printer which transfers dye ink of an ink sheet to a printing medium to print an image, the method comprising: an input step of inputting information; and a control step of controlling transfer of the overcoat, wherein in the control step, information to be input in the input step is formed by forming, in the overcoat transferred onto the entire image, a non-transfer portion where no overcoat is transferred, and the overcoat is transferred to form portions having different glosses at an overcoat transfer portion in the vicinity of the non-transfer portion.

According to the present invention, a pattern is transferred in the vicinity of information embedded in a printed image by overcoat printing. The information can be disguised not to be visually perceivable, enhancing concealment of the information.

Further features of the present invention will become apparent from the following description of exemplary embodiments (with reference to the attached drawings).

DESCRIPTION OF THE EMBODIMENTS

Embodiments of the present invention will be described in detail below. The following embodiments are merely examples for practicing the present invention. The embodiments should be properly modified or changed depending on various conditions and the structure of an apparatus to which the present invention is applied. The present invention should not be limited to the following embodiments. Also, parts of the embodiments to be described later may be properly combined.

[First Embodiment]

A thermal printer and overcoat printing method according to the first embodiment will be described.

First, the arrangement of the thermal printer will be described with reference to FIG. 2.

Figure 2:
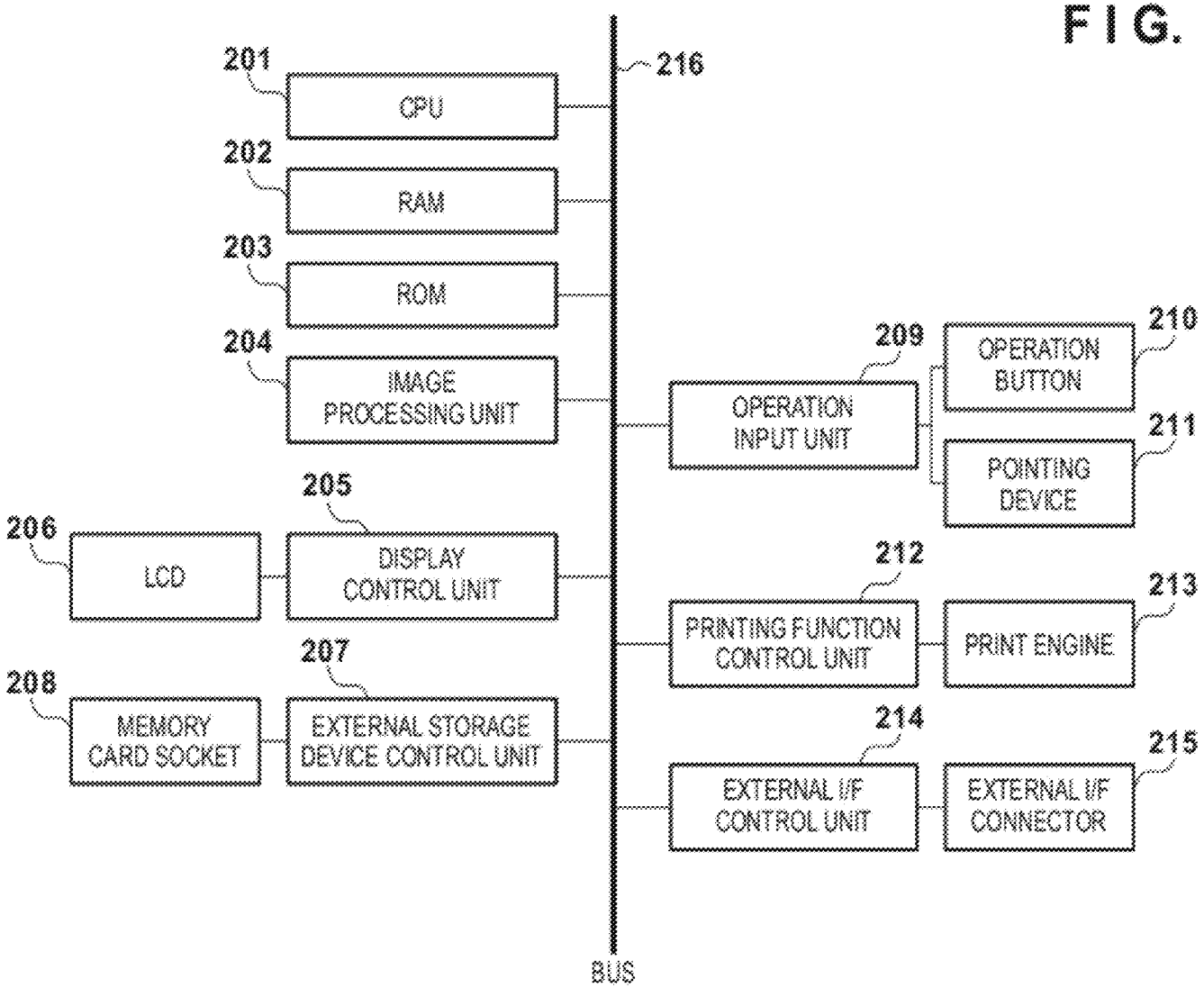
FIG. 2 is a block diagram showing the arrangement of a thermal printer according to the embodiment.

Referring to FIG. 2, a CPU (Central Processing Unit) 201 controls the overall thermal printer. A RAM (Random Access Memory) 202 is used as a work area for the CPU 201. A ROM (Read Only Memory) 203 stores the processing procedures of the CPU 201, and is formed from a programmable nonvolatile memory such as a flash memory. An image processing unit 204 is used for processing of converting digital image data or the like into screen displayable data, and processing of detecting face parts and a face within image data. A display control unit 205 provides various displays. An LCD (Liquid Crystal Display) 206 is used to display an image such as image data or operation information on the screen of the thermal printer. An external storage device control unit 207 controls read of digital data stored in a card storage medium inserted into a memory card socket 208, and write of digital data on the storage medium. An operation input unit 209 notifies the CPU 201 of operation information of an operation button 210 and pointing device 211. Note that the pointing device 211 suffices to be able to acquire coordinate information, and corresponds to a touch panel or mouse. A printing function control unit 212 of the thermal printer controls a print engine 213 to print digital data. An external interface control unit 214 typified by a USB interface allows connecting another apparatus via an external interface connector 215. A bus 216 communicably connects these elements.

A thermal head which forms the print engine 213 shown in FIG. 2 will be explained with reference to FIG. 3.

Figure 3:
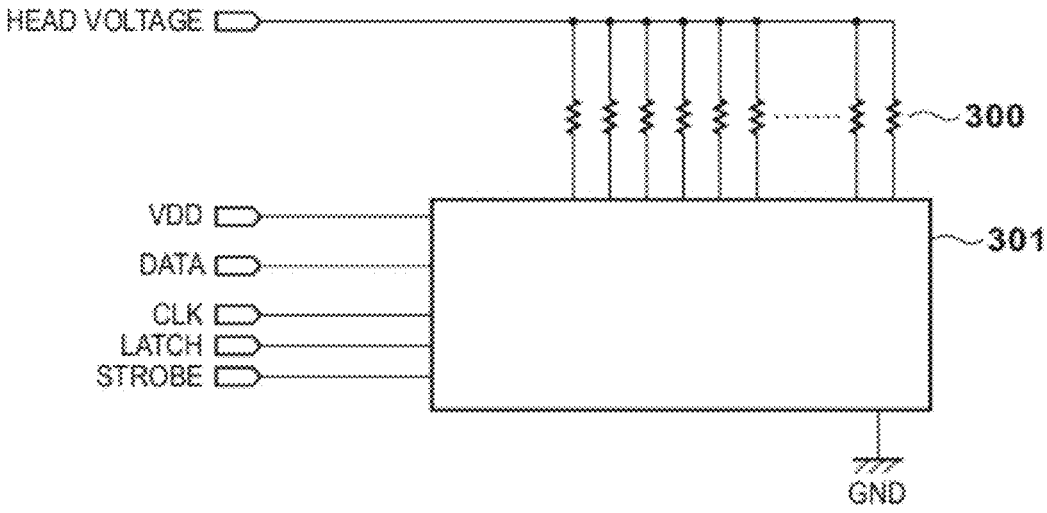
FIG. 3 is a diagram showing a block including the thermal head power supply, line heater, and driving IC of the thermal printer according to the embodiment.

In FIG. 3, the thermal head is formed from line heaters 300 and a driving IC 301 for them. A head voltage is applied to the line heaters 300 while power supply VDD is applied to the head driving IC 301. The line heaters 300 are formed in line by the number of dots in the main scanning direction of the thermal head. Heaters to be energized are determined by a combination of CLK, LATCH, STROBE, and DATA signals. Arbitrary dots can be formed at an arbitrary timing by inputting, to the head driving IC 301, the CLK, LATCH, STROBE, and DATA signals generated by the image processing unit 204 in FIG. 2.

The 1-dot density tonal number of the thermal printer can be expressed by application energy to one dot that is generated by printing pulses within a predetermined time in the sub scanning direction. For example, a density tonal number (number of tone) of 0 to 511 is expressed. When the number of printing pulses within a predetermined time in the sub scanning direction is 0 for a given dot, the dot tonal number corresponds to 0 energy, and when the number of printing pulses is 511, corresponds to the application energy.

In the description of the first and subsequent embodiments, the number of printing pulses within a predetermined time in the sub scanning direction will be referred to as a 1-dot printing tonal number. As described above, the thermal printer can control the ink transfer amount of the ink ribbon by the 1-dot printing tonal number. Thus, the thermal printer can control not only the transfer amount of color ink for a dye layer, but also that of ink for an overcoat layer (OC) for protecting a printed image. Note that the ink ribbon is formed from Y (Yellow), M (Magenta), and C (Cyan) dye layers which give printing colors to a printing medium, and an OC which protects a printed image.

When the OC ink transfer amount is controlled to set an OC transfer amount of 0 at an arbitrary portion on a printed image, this portion serves as hidden information. When the surface of the printing medium after printing is rubbed with an eraser or the like, the dye layer at the hidden information portion is peeled off, removing the printing color. When the printing medium is visually checked from the front, the reflectance difference is small between the OC transferred portion and the portion where the OC transfer amount is 0. Thus, these portions are hardly discriminated from each other as long as the surface of the printing medium is visually checked from the front. By using this property, hidden information can be printed on a printing medium by performing print processing using an arbitrary portion as a portion where the OC transfer amount is 0. The surface of the printing medium after printing is rubbed with an eraser or the like, removing the printing color at the portion where the OC transfer amount is 0. The hidden information printed on the printing medium appears and can be read.

The thermal printer according to the embodiment can print hidden information by printing information at an OC transfer amount of 0 (zero tonal number).

Print processing for image data by the thermal printer according to the first embodiment will be described with reference to FIG. 4. Assume that image data to be printed is stored in a memory card inserted into the memory card socket 208 of the thermal printer. Processing shown in FIG. 4 is executed by expanding a firmware program stored in the ROM 203 by the CPU 201 into the RAM 202 upon power-on of the thermal printer.

Figure 4:
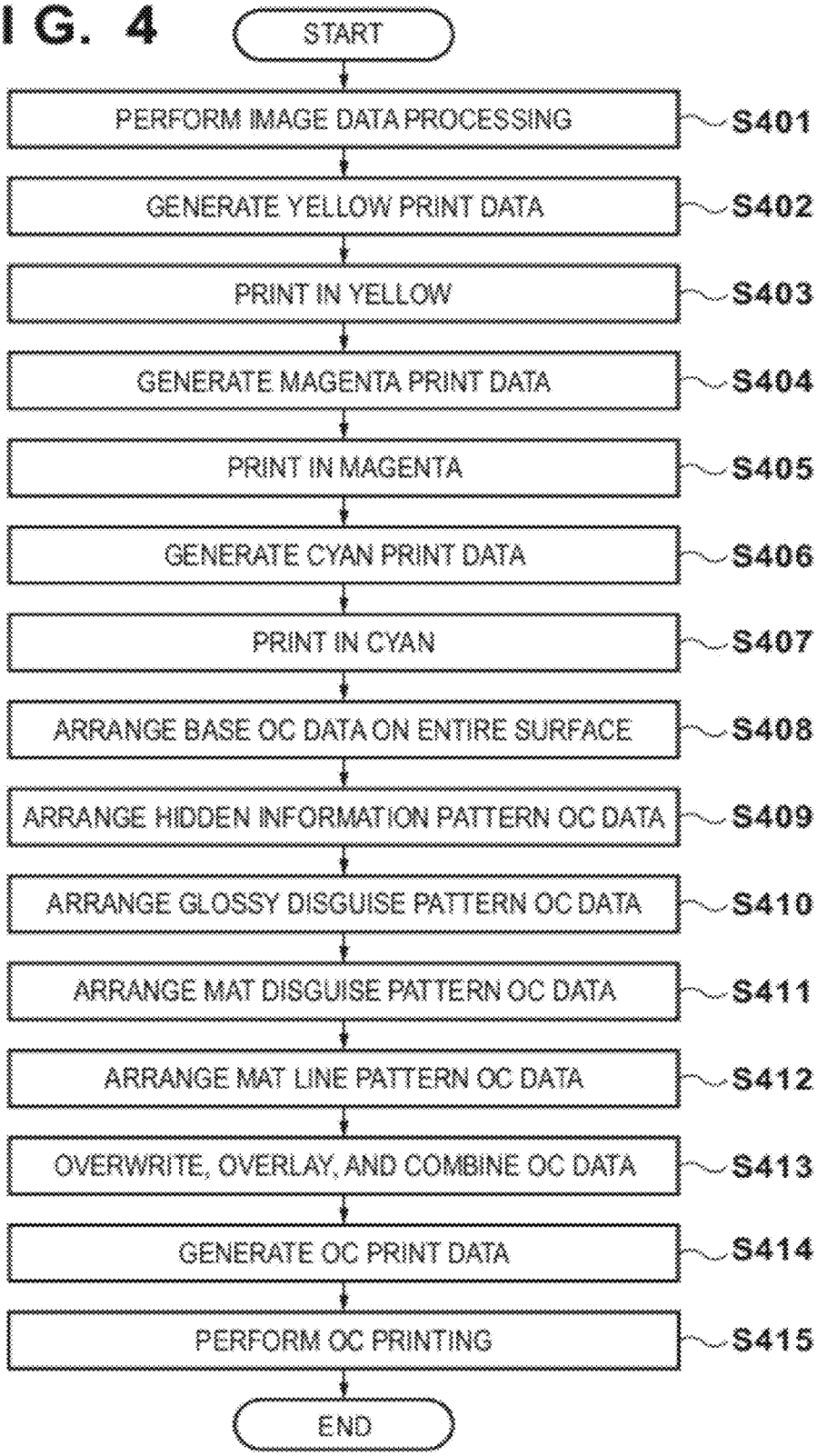
FIG. 4 is a flowchart showing print processing by the thermal printer according to the first embodiment.

In FIG. 4, the CPU 201 reads out image data from the memory card inserted into the memory card socket 208, and controls the image processing unit 204 to perform image processing to generate yellow, magenta, and cyan print data (step S401). The CPU 201 generates yellow print data (step S402) and prints in yellow (step S403). Then, the CPU 201 generates magenta print data (step S404) and prints in magenta (step S405). The CPU 201 generates cyan print data (step S406) and prints in cyan (step S407).

Note that yellow, magenta, and cyan print data used in the description of the embodiment are digital data to be sent to the printing function control unit 212 after image processing by the image processing unit 204.

After the end of printing in yellow, magenta, and cyan, the CPU 201 controls the image processing unit 204 in FIG. 2 to execute overcoat print data (to be referred to as OC print data) processing.

In step S408, base OC data of a constant tonal number is arranged on the entire surface.

In step S409, hidden information pattern OC data is arranged.

In step S410, glossy disguise pattern OC data is arranged.

In step S411, mat disguise pattern OC data is arranged.

In step S412, mat line pattern OC data is arranged.

In step S413, the OC data arranged in steps S408 to S412 are overwritten, overlaid, and combined.

In step S414, OC print data is generated from the OC data combined in step S413. In step S415, OC printing is performed.

Note that OC print data used in the description of the embodiment is digital data to be sent to the printing function control unit 212 after OC print data processing by the image processing unit 204.

Disguise patterns for shielding hidden information by OC print data processing in steps S408 to S412 and the print procedures will be explained with reference to FIGS. 5A to 5F and 6.

Note that a pixel used in the description of the embodiment is a minimum pixel unit in image processing. A pixel and one dot of the heater may correspond to each other equally or at an arbitrary ratio.

Figure 5A:
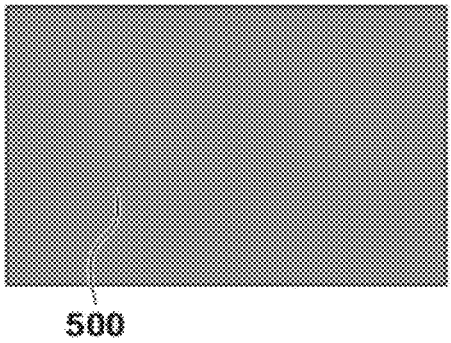
FIGS. 5A to 5F are views for explaining disguise patterns for hidden information and the print procedures according to the first embodiment.

FIG. 5A conceptually shows a state in which base OC data 500 is arranged on the entire surface in step S408. Note that glossy base OC data used in the description of the embodiment is OC data to be printed to cover part or all of a printing medium at a finite thickness.

The base OC data 500 is transferred to cover the entire surface of a printing medium. Thus, the 1-dot printing tonal number is set to a constant tonal number Pbase for the number of dots corresponding to the entire surface of the printing medium. Pbase is a tonal number which falls within P(gloss): glossy OC tone range in FIG. 6 and improves OC transfer stability and surface glossiness in normal printing.

Figure 5B:
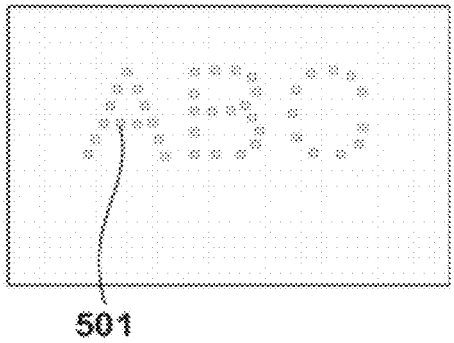

FIG. 5B conceptually shows a state in which hidden information pattern data is arranged in step S409. Square dots (to be referred to as image blocks) each formed from a plurality of pixels are set. The 1-dot printing tonal number is set to a tonal number which falls within P(zero): zero-OC tone range in FIG. 6 so that no OC is transferred onto a printing medium. The preset image blocks are arranged as a hidden information pattern 501. In the first embodiment, the hidden information indicates characters "ABC".

Figure 5C:
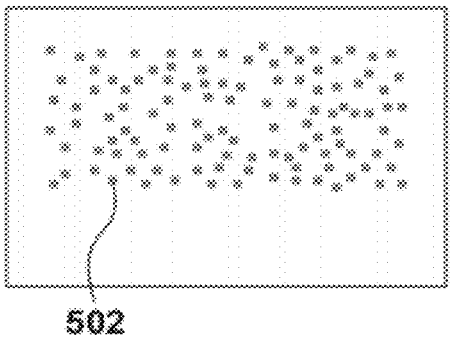

FIG. 5C conceptually shows a state in which glossy disguise pattern OC data is arranged in step S410. Square OC image blocks each formed from a plurality of pixels are set. The 1-dot printing tonal number is set to a tonal number which falls within P(gloss): glossy OC tone range in FIG. 6 and differs from Pbase. The OC image blocks are arranged as a glossy disguise pattern 502.

Figure 5D:
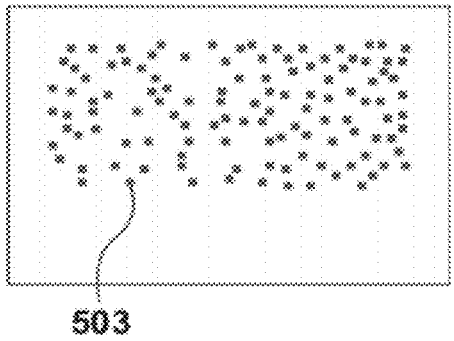

FIG. 5D conceptually shows a state in which mat disguise pattern OC data is arranged in step S411. Square OC image blocks each formed from a plurality of pixels are set. The 1-dot printing tonal number is set to a tonal number which falls within P(mat): mat OC tone range in FIG. 6 so that the OC is transferred onto a printing medium while the OC surface becomes less glossy. The OC image blocks are arranged as a mat disguise pattern 503.

Figure 5E:
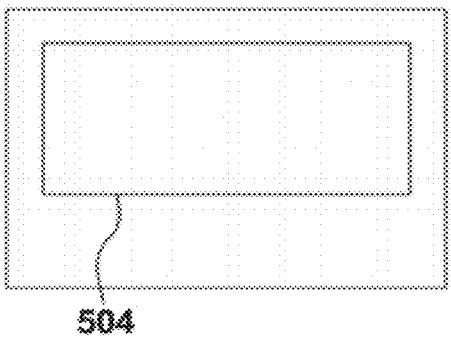

FIG. 5E conceptually shows a state in which mat line pattern OC data is arranged in step S412. A mat line pattern 504 is a line pattern for explicitly indicating the arrangement portion of the hidden information pattern 501 on a printed image. The 1-dot printing tonal number of the mat line pattern 504 is set to a tonal number which falls within P(mat): mat OC tone range in FIG. 6 so that the OC is transferred onto a printing medium while the OC surface becomes less glossy.

Figure 5F:
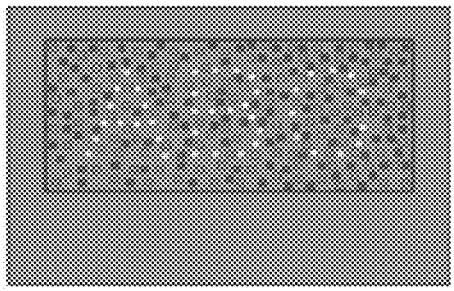

FIG. 5F conceptually shows a state in which the OC image blocks of the base OC data 500, hidden information pattern 501, glossy disguise pattern 502, mat disguise pattern 503, and mat line pattern 504 are combined and arranged in step S413. To avoid the interference between OC data of the respective patterns, overwrite & overlay combination of pattern data is executed without performing addition/subtraction between the patterns.

Note that overwrite & overlay combination of pattern data means replacing pixels corresponding to the image blocks of previously arranged OC data with those corresponding to the image blocks of OC data to be arranged later.

Overwrite & overlay combination of pattern data in the first embodiment is executed in order of the base OC data 500, glossy disguise pattern 502, mat disguise pattern 503, mat line pattern 504, and hidden information pattern 501.

That is, the base OC data 500 serves as the lowermost layer of the overlay, and the hidden information pattern 501 serves as the uppermost layer of the overlay. Pixels corresponding to the hidden information pattern 501 on the OC data have a tonal number falling within P(zero): zero-OC tone range.

Figures 7A, 7B, 7C:
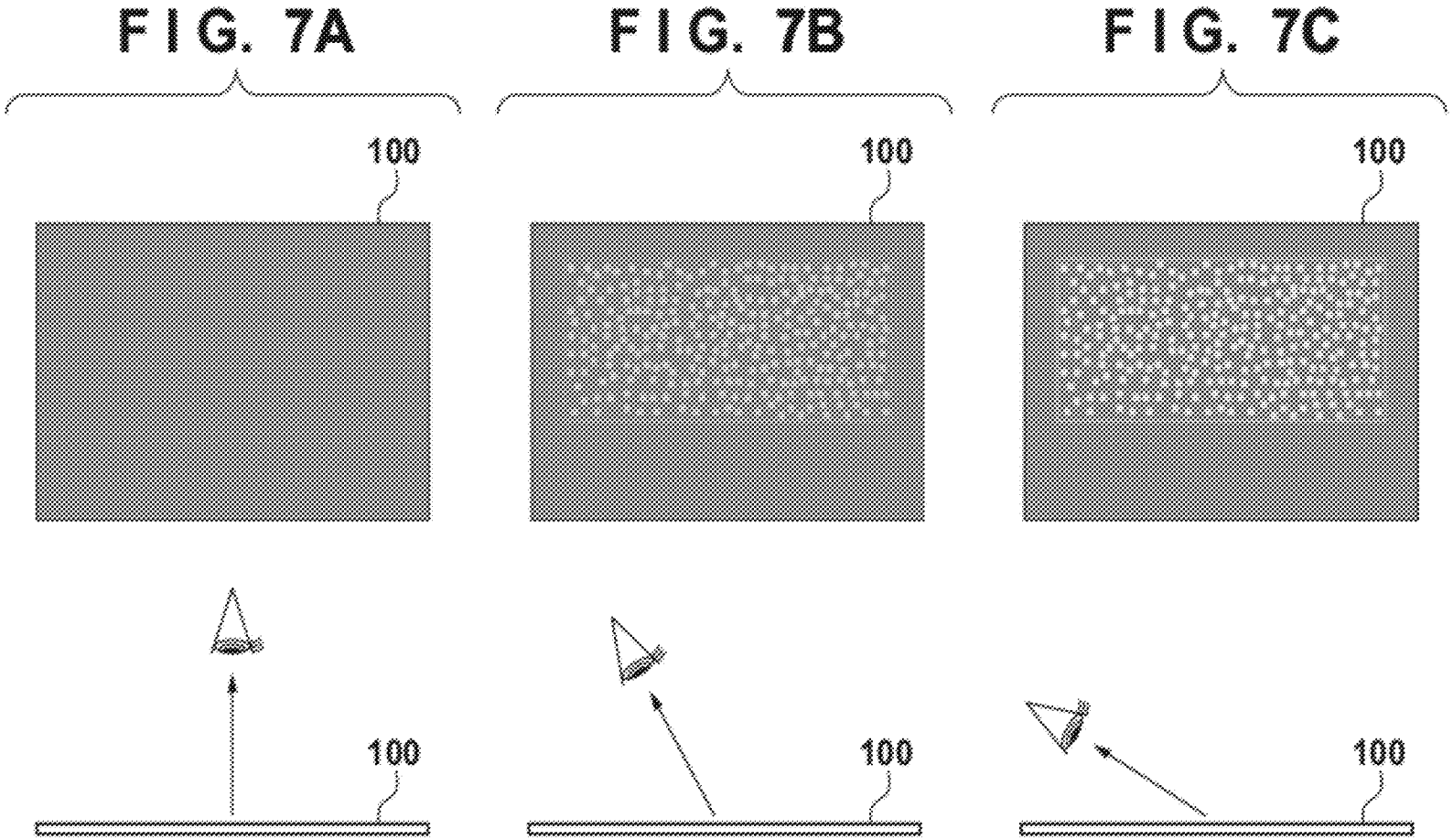
FIGS. 7A to 7C are views visually showing states of a printing medium having undergone overcoat printing according to the first embodiment when viewed from different angles.

FIGS. 7A to 7C visually show states of a printing medium having undergone overcoat printing according to the first embodiment when viewed from different angles.

When the printing medium is viewed from the front, as shown in FIG. 7A, the surface state of the printed OC is hardly visually perceivable. When the printing medium is viewed slightly obliquely, as shown in FIG. 7B, the surface state of the printed OC is slightly visually perceivable.

When the printing medium is viewed further obliquely, as shown in FIG. 7C, the surface state of the printed OC is visually perceivable. At this time, however, hidden information printed on the printing medium is disguised by the disguise patterns, so it is difficult to read it.

Figure 8A:
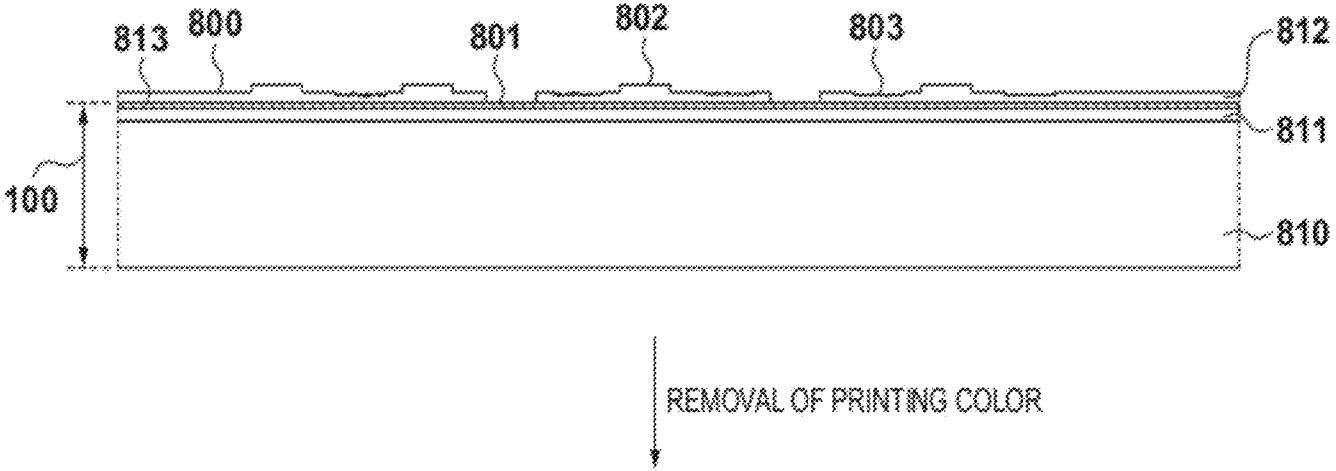
FIGS. 8A and 8B are sectional views of a printing medium having undergone overcoat printing according to the first embodiment.
Figure 8B:
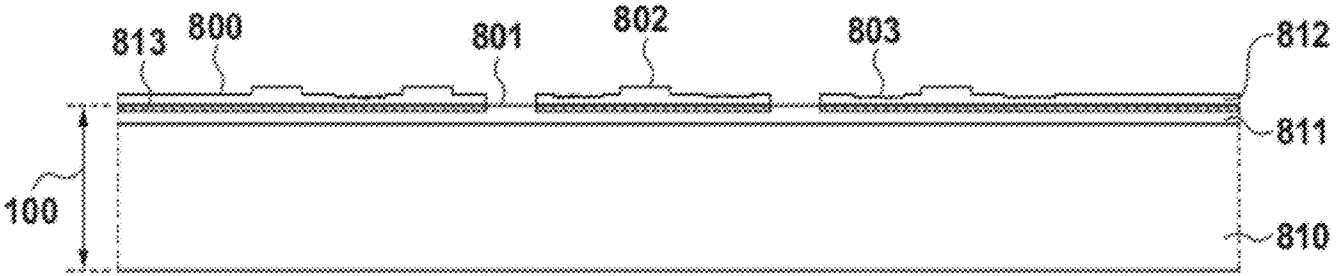

FIGS. 8A and 8B are sectional views of a printing medium having undergone OC printing according to the first embodiment. A printing medium 100 is formed from a base film 810 and dye receiving layer 811, and an OC 812 is transferred on the top layer. A dye 813 sublimated from the ink ribbon exists on the dye receiving layer 811 and forms a printing color.

FIG. 8A shows a state unchanged after printing. FIG. 8B shows a state in which the arrangement portion of the hidden information pattern 501 is rubbed with an eraser or the like after printing to remove the dye which forms a printing color at a portion corresponding to the hidden information pattern 501 so that the hidden information can be read.

Figure 6:
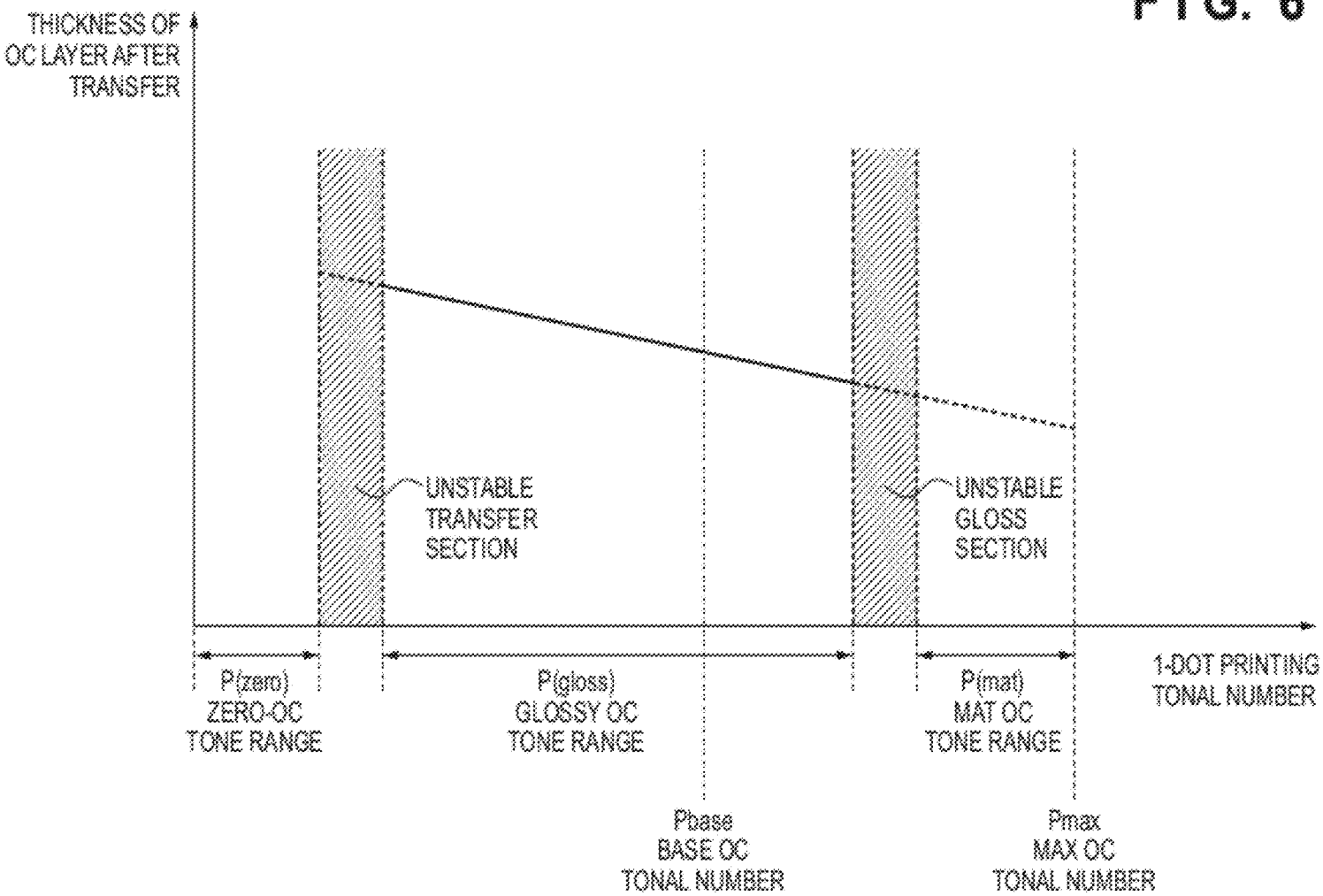
FIG. 6 is a graph exemplifying the characteristic curve of the 1-dot printing tonal number with respect to the thickness of an overcoat layer by overcoat print processing according to the first embodiment.

The OC thickness of each pattern section below can be obtained from the characteristic curve of the 1-dot printing tonal number with respect to the OC thickness after transfer in FIG. 6.

800: base OC section P(base)

801: OC section corresponding to the image block of the hidden information pattern P(zero)

802: OC section corresponding to the OC image block of the glossy disguise pattern P(gloss)

803: OC section corresponding to the OC image block of the mat disguise pattern P(mat)

In a range except for the P(zero), the OC thickness after transfer is larger for a lower 1-dot printing tonal number, and smaller for a higher 1-dot printing tonal number.

An unstable transfer section where OC transfer becomes unstable exists between P(zero): zero-OC tone range and P(gloss): glossy OC tone range. When controlling the OC printing tonal number, no printing tonal number within the unstable transfer section is adopted.

Also, an unstable gloss section where OC gloss becomes unstable exists between P(gloss): glossy OC tone range and P(mat): mat OC tone range. When controlling the OC printing tonal number, no printing tonal number within the unstable gloss section is employed.

The respective patterns differ from each other in thickness and glossiness. Even if the light reflection state on the surface of a printing medium changes when the printing medium is viewed from various angles, hidden information disappears from the sight in the disguise patterns, and it is difficult to read the hidden information.

Figure 1A:
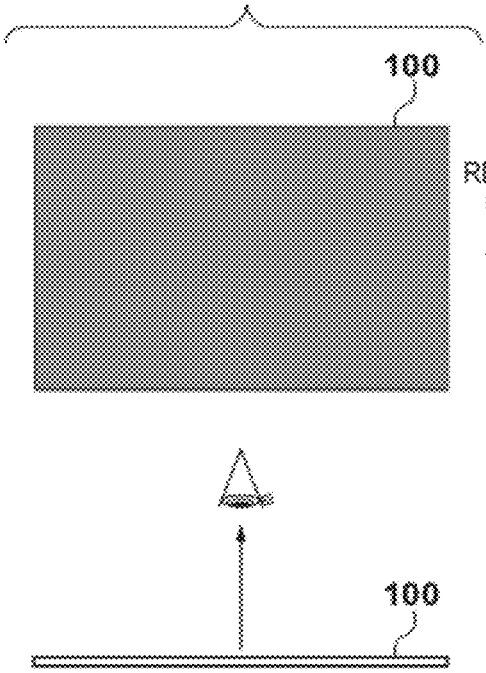
FIGS. 1A and 1B are views visually showing hidden information on a printing medium having undergone overcoat printing according to an embodiment of the present invention.
Figure 1B:
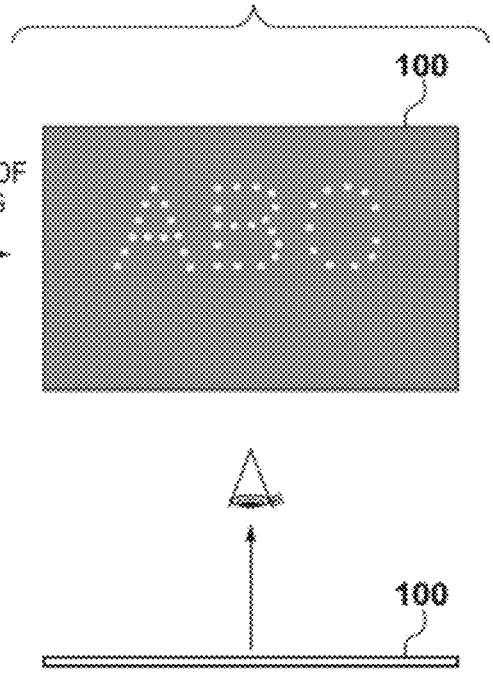

FIGS. 1A and 1B visually show a hidden information pattern on a printing medium having undergone OC printing according to the first embodiment.

When the printing medium is viewed from the front in a state unchanged after printing, as shown in FIG. 8A, hidden information is hardly visually perceivable. A visual expression of this is as in FIG. 1A. When the printing medium is viewed from the front in a state in which hidden information can be read as in FIG. 8B, a hidden information pattern "ABC" appears and the hidden information can be read. A visual expression of this is as in FIG. 1B. In the state in which hidden information can be read as in FIG. 8B, the hidden information pattern can be read regardless of the angle from which the printing medium is viewed.

According to the first embodiment, a disguise pattern is embedded in the vicinity of hidden information embedded in a printed image by overcoat printing. The hidden information can be disguised against incidence/reflection of light and visual perception on a printing medium in any direction, enhancing concealment of the hidden information.

Disguise data also has an effect of explicitly indicting that hidden information is embedded at an arbitrary portion on a printing medium.

The first embodiment has explained an overcoat transfer method when embedding hidden information in the overcoat. The user can set whether to embed hidden information in the overcoat. It is also possible to set a printing mode in which hidden information is embedded in the overcoat and a printing mode in which it is not embedded, and select either one by the user. Alternatively, a character or figure to be embedded as hidden information may be set to automatically switch to a mode in which hidden information is embedded. When it is set to embed hidden information in the overcoat, the overcoat is transferred in the above-described way. When it is set not to embed hidden information in the overcoat, the overcoat is uniformly transferred onto the entire image using overcoat data for which the same tone value is set for the entire surface as in FIG. 5A.

[Second Embodiment]

A thermal printer and overcoat printing method according to the second embodiment will be described. The block arrangement of the thermal printer which implements the second embodiment is the same as that in the above-described first embodiment, and a description thereof will not be repeated.

In the first embodiment, the base OC data 500, hidden information pattern 501, glossy disguise pattern 502, mat disguise pattern 503, and mat line pattern 504 are combined to generate OC print data. To the contrary, in the second embodiment, a mat base pattern 505 is combined instead of the mat line pattern 504, generating OC print data.

Note that the mat base pattern OC data is data for transferring an OC to be printed to cover part or all of a printing medium at a finite thickness, and especially a mat OC onto the surface of a printing medium.

Print processing by the thermal printer according to the second embodiment will be described with reference to FIG. 9. The basic processing sequence is the same as that in FIG. 4, and only a difference will be explained. Processing shown in FIG. 9 is executed by expanding a firmware program stored in a ROM 203 by a CPU 201 into a RAM 202 upon power-on of the thermal printer.

Figure 9:
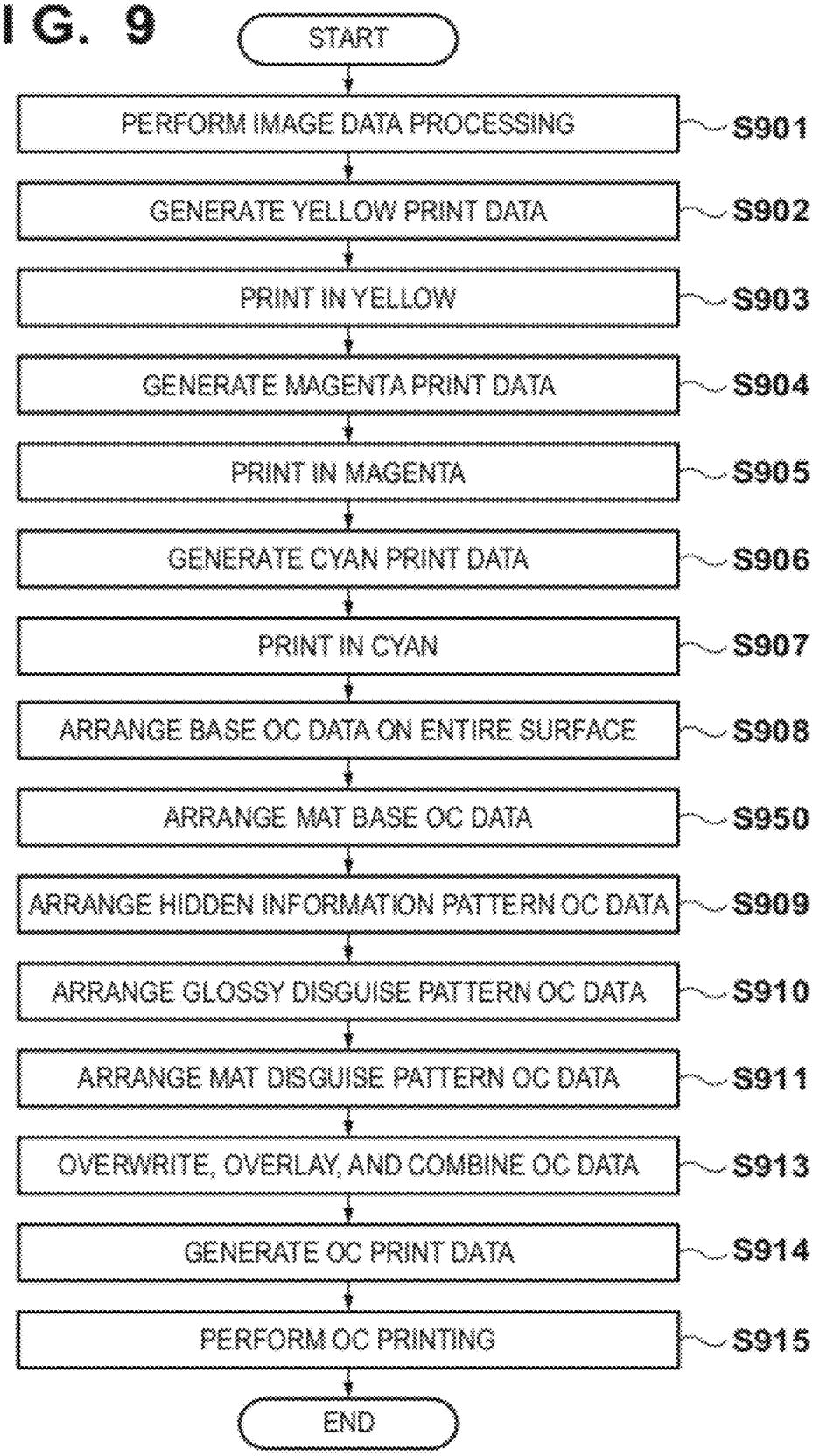
FIG. 9 is a flowchart showing print processing by a thermal printer according to the second embodiment.

In FIG. 9, steps S901 to S907 are the same processes as those in steps S401 to S407 of FIG. 4. After the end of printing in yellow, magenta, and cyan, the CPU 201 controls an image processing unit 204 in FIG. 2 to execute OC print data processing.

In step S908, base OC data of a base tonal number is arranged on the entire surface.

In step S950, mat base pattern OC data is arranged.

In step S909, hidden information pattern OC data is arranged.

In step S910, glossy disguise pattern OC data is arranged.

In step S911, mat disguise pattern OC data is arranged.

In step S913, the OC data arranged in steps S908 to S911 are overwritten, overlaid, and combined.

In step S914, OC print data is generated from the OC data combined in step S913. In step S915, OC printing is performed.

Note that OC print data used in the description of the embodiment is digital data to be sent to a printing function control unit 212 after OC print data processing by the image processing unit 204.

Disguise patterns for hidden information by OC print data processing in steps S908 to S911 and the print procedures will be explained with reference to FIGS. 10A to 10F.

Figure 10A:
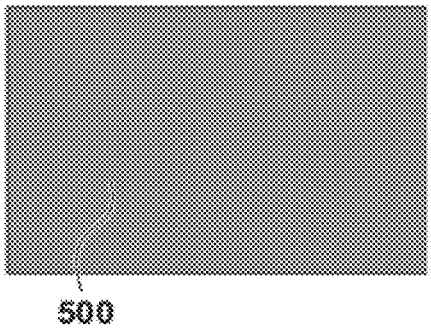
FIGS. 10A to 10F are views for explaining disguise patterns for hidden information and the print procedures according to the second embodiment.

FIG. 10A conceptually shows a state in which base OC data 500 is arranged on the entire surface in step S908. This data is the same as that in the first embodiment, and a description thereof will not be repeated.

Figure 10B:
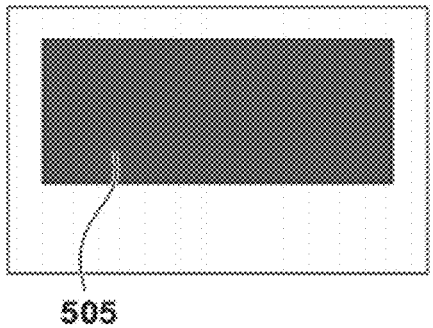

FIG. 10B conceptually shows a state in which the mat base pattern OC data 505 is arranged in step S950. As shown in FIG. 10B, the mat base pattern OC data 505 is arranged to contain the arrangement portion of a hidden information pattern 501 on a printing medium. The 1-dot printing tonal number is set to a tonal number which falls within P(mat): mat OC tone range in FIG. 6 so that the OC is transferred onto a printing medium while the OC surface becomes less glossy.

Figure 10C:
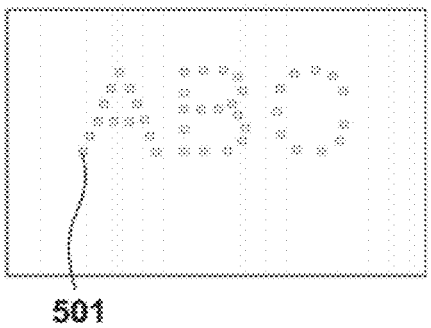

FIG. 10C conceptually shows a state in which the hidden information pattern data 501 is arranged in step S909. This data is the same as that in the first embodiment, and a description thereof will not be repeated.

Figure 10D:
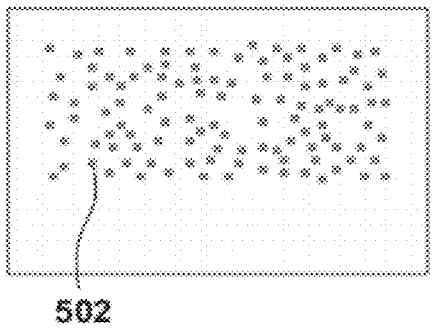

FIG. 10D conceptually shows a state in which glossy disguise pattern OC data is arranged in step S910. Square OC image blocks each formed from a plurality of pixels are set. The 1-dot printing tonal number is set to a tonal number which falls within P(gloss): glossy OC tone range in FIG. 6 so that the OC is transferred onto a printing medium with a glossy OC surface. The OC image blocks are arranged as a glossy disguise pattern 502.

Figure 10E:
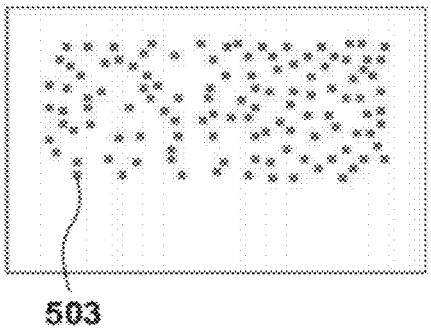

FIG. 10E conceptually shows a state in which mat disguise pattern OC data is arranged in step S911. Square OC image blocks each formed from a plurality of pixels are set. The 1-dot printing tonal number is set to a tonal number which falls within P(mat): mat OC tone range in FIG. 6 and differs from the tonal number of the mat base pattern OC data 505 set in step S950. The OC image blocks are arranged as a mat disguise pattern 503.

Figure 10F:
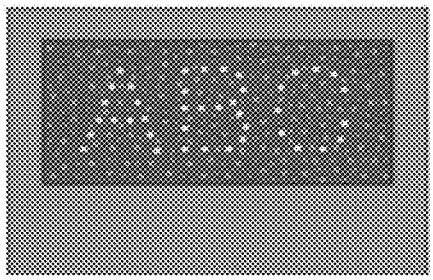

FIG. 10F conceptually shows a state in which the OC image blocks of the base OC data 500, mat base pattern OC data 505, hidden information pattern 501, glossy disguise pattern 502, and mat disguise pattern 503 are combined and arranged in step S913.

To avoid the interference between OC data of the respective patterns, overwrite & overlay combination of pattern data is executed without performing addition/subtraction between the patterns.

Note that overwrite & overlay combination of pattern data means replacing pixels corresponding to the image blocks of previously arranged OC data with those corresponding to the image blocks of OC data to be arranged later.

Overwrite & overlay combination of pattern data in the second embodiment is executed in order of the base OC data 500, the mat base pattern OC data 505, the glossy disguise pattern 502, the mat disguise pattern 503, and the hidden information pattern 501. That is, the base OC data 500 serves as the lowermost layer of the overlay, and the hidden information pattern 501 serves as the uppermost layer of the overlay. Pixels corresponding to the hidden information pattern 501 on the OC data have a tonal number falling within P(zero): zero-OC tone range.

Figures 11A, 11B, 11C:
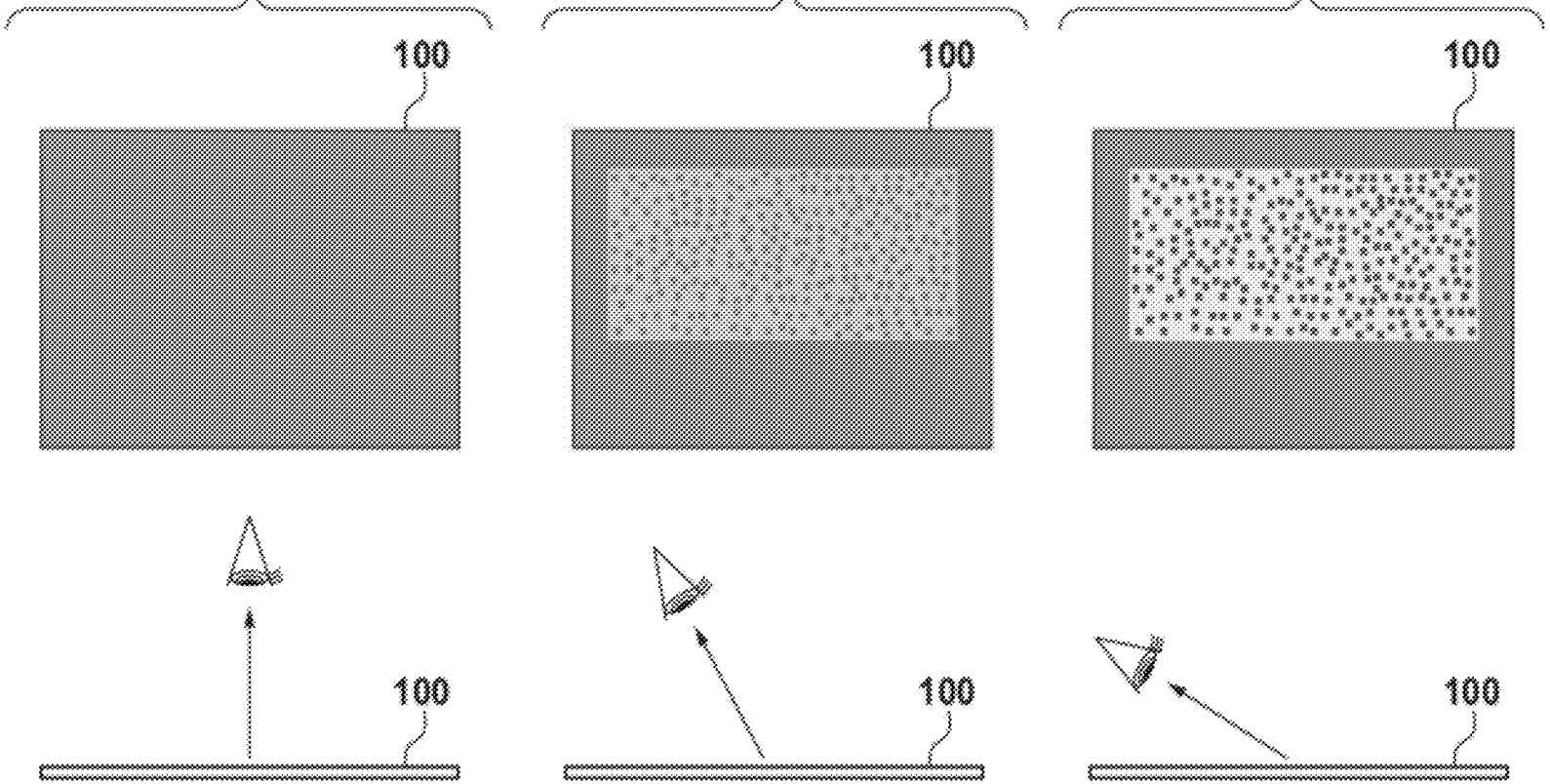
FIG. 11A to 11C are views visually showing states of a printing medium having undergone overcoat printing according to the second embodiment when viewed from different angles.

FIGS. 11A to 11C visually show states of a printing medium having undergone overcoat printing according to the second embodiment when viewed from different angles. The second embodiment is different from the first embodiment in that a hidden information pattern on a printing medium is arranged in the mat base OC region.

When the printing medium is viewed from the front, as shown in FIG. 11A, the surface state of the printed OC is hardly visually perceivable. When the printing medium is viewed slightly obliquely, as shown in FIG. 11B, the surface state of the printed OC is slightly visually perceivable.

When the printing medium is viewed further obliquely, as shown in FIG. 11C, the surface state of the printed OC is visually perceivable. At this time, however, hidden information printed on the printing medium is disguised by the disguise patterns, so it is difficult to read the hidden information.

Figure 12A:
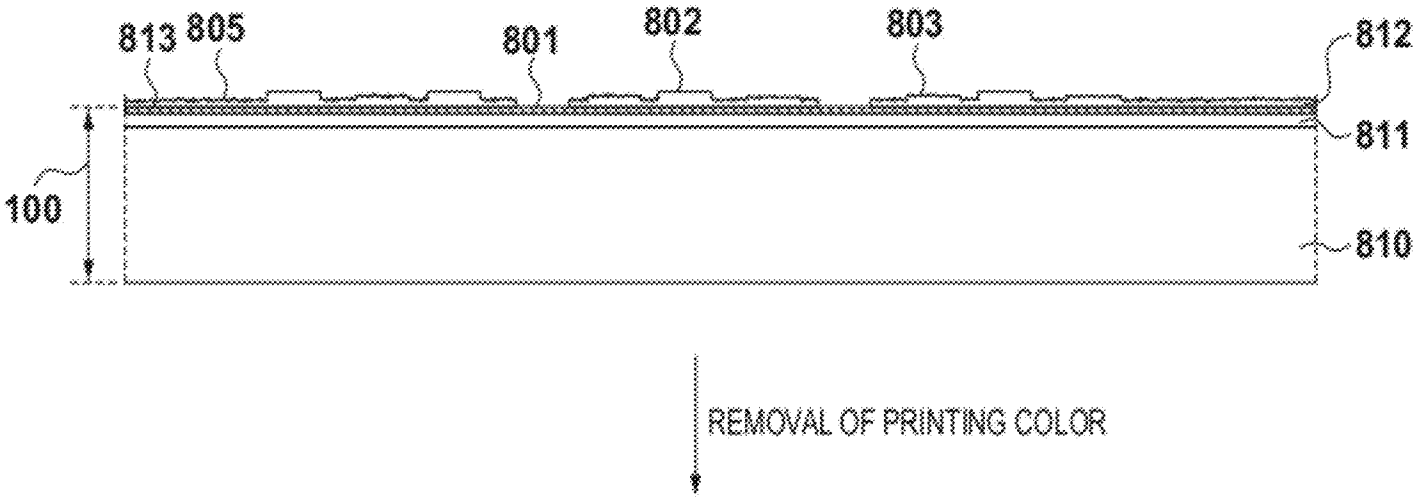
FIGS. 12A and 12B are sectional views of a printing medium having undergone overcoat printing according to the second embodiment.
Figure 12B:
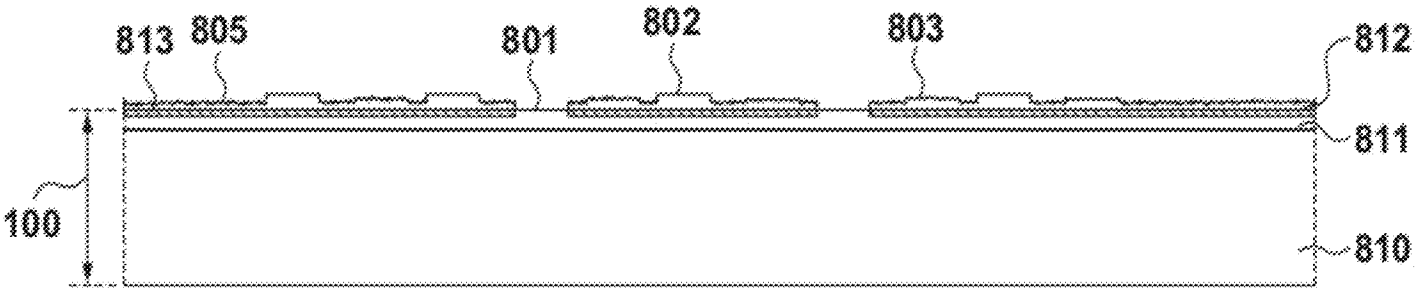

FIGS. 12A and 12B are sectional views of a printing medium having undergone OC printing according to the second embodiment. The second embodiment is different from the first embodiment in that a hidden information pattern 801 on a printing medium is arranged in the region of a mat base OC 805.

FIG. 12A shows a state unchanged after printing. FIG. 12B shows a state in which the arrangement portion of the hidden information pattern 501 is rubbed with an eraser or the like after printing to remove the dye which forms a printing color at a portion corresponding to the hidden information pattern 501 so that the hidden information can be read.

The thickness of the OC section of each pattern below can be obtained from the characteristic curve of the 1-dot printing tonal number with respect to the OC thickness after transfer in FIG. 6. Details of this are the same as those in the first embodiment, and a description thereof will not be repeated.

805: mat base OC section

801: OC section corresponding to the image block of the hidden information pattern

802: OC section corresponding to the OC image block of the glossy disguise pattern

803: OC section corresponding to the OC image block of the mat disguise pattern The respective patterns differ from each other in thickness and glossiness. Even if the light reflection state on the surface of a printing medium changes when the printing medium is viewed from various angles, hidden information disappears from the sight in the disguise patterns, and it is difficult to read the hidden information.

FIGS. 1A and 1B visually show a hidden information pattern on a printing medium having undergone OC printing according to the second embodiment. The appearance of the hidden information pattern is almost the same as that in the first embodiment.

When the printing medium is viewed from the front in a state unchanged after printing, as shown in FIG. 12A, hidden information is hardly visually perceivable. A visual expression of this is as in FIG. 1A. When the printing medium is viewed from the front in a state in which hidden information can be read as in FIG. 12B, a hidden information pattern "ABC" appears and the hidden information can be read. A visual expression of this is as in FIG. 1B. In the state in which hidden information can be read as in FIG. 12B, the hidden information pattern can be read regardless of the angle from which the printing medium is viewed.

[Third Embodiment]

A thermal printer and overcoat printing method according to the third embodiment will be described. The block arrangement of the thermal printer which implements the third embodiment is the same as that in the above-described first embodiment, and a description thereof will not be repeated.

In the first and second embodiments, hidden information and the disguise pattern are formed from square image blocks. However, each dot of an image block is not limited to a square shape, and suffices to have an arbitrary shape formed from a plurality of pixels. As the third embodiment, square, circular, and triangular image blocks will be explained.

Print processing by the thermal printer according to the third embodiment is the same as that in FIG. 4, and a description thereof will not be repeated.

Figure 13A:
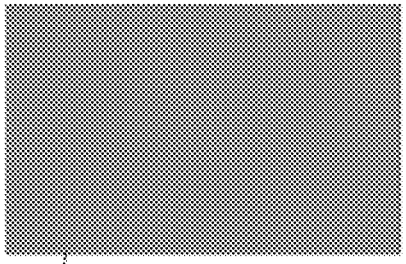
FIGS. 13A to 13F are views for explaining disguise patterns for hidden information and the print procedures according to the third embodiment.

FIG. 13A conceptually shows a state in which base OC data 1300 is arranged on the entire surface. The base OC data 1300 is transferred to cover the entire surface of a printing medium. Thus, the 1-dot printing tonal number is set to a constant tonal number Pbase for the number of dots corresponding to the entire surface of the printing medium. Pbase is a tonal number which falls within P(gloss): glossy OC tone range in FIG. 6 and improves OC transfer stability and surface glossiness in normal printing.

Figure 13B:
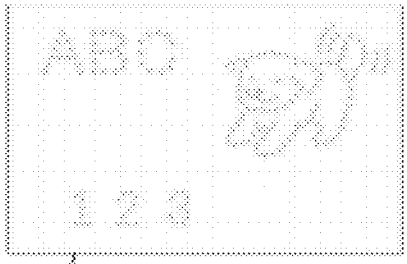

FIG. 13B conceptually shows a state in which hidden information pattern data is arranged. Square, circular, and triangular image blocks each formed from a plurality of pixels are set. The 1-dot printing tonal number is set to a tonal number which falls within P(zero): zero-OC tone range in FIG. 6 so that no OC is transferred onto a printing medium. The set image blocks are arranged as a hidden information pattern 1301. In the third embodiment, the hidden information includes characters "ABC", numeral "123", and picture "animal".

Figure 13C:
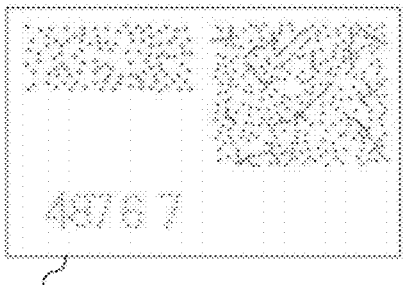

FIG. 13C conceptually shows a state in which glossy disguise pattern OC data is arranged. Square, circular, and triangular image blocks each formed from a plurality of pixels are set. The 1-dot printing tonal number is set to a tonal number which falls within P(gloss): glossy OC tone range in FIG. 6 and differs from Pbase. The set image blocks are arranged as a glossy disguise pattern 1302. In this case, a numeral "48767" is overlaid and arranged to disguise the hidden information numeral "123".

Figure 13D:
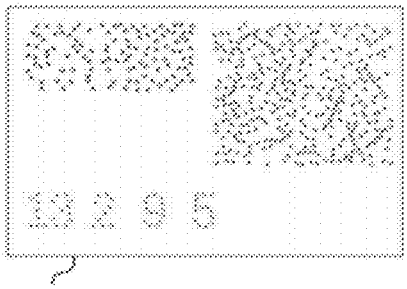

FIG. 13D conceptually shows a state in which mat disguise pattern OC data is arranged. Square, circular, and triangular image blocks each formed from a plurality of pixels are set. The 1-dot printing tonal number is set to a tonal number which falls within P(mat): mat OC tone range in FIG. 6 so that the OC is transferred onto a printing medium while the OC surface becomes less glossy. The set image blocks are arranged as a mat disguise pattern 1303. In this case, a numeral "13295" is overlaid and arranged to disguise the hidden information numeral "123".

Figure 13E:
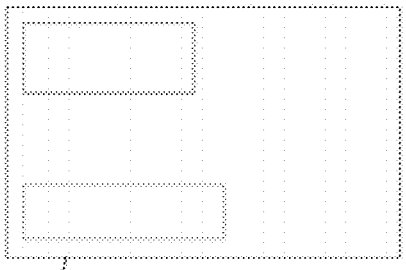

FIG. 13E conceptually shows a state in which mat line pattern OC data is arranged. The 1-dot printing tonal number of a mat line pattern 1304 is set to a tonal number which falls within P(mat): mat OC tone range in FIG. 6 so that the OC is transferred onto a printing medium while the OC surface becomes less glossy.

Figure 13F:
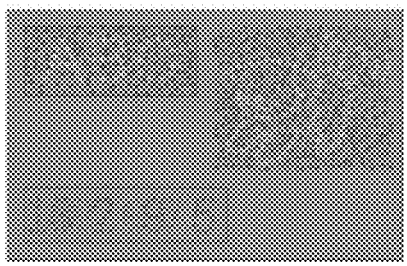

FIG. 13F conceptually shows a state in which the OC image blocks of the base OC data 1300, hidden information pattern 1301, glossy disguise pattern 1302, mat disguise pattern 1303, and mat line pattern 1304 are combined and arranged. To avoid the interference between OC data of the respective patterns, overwrite & overlay combination of pattern data is executed without performing addition/subtraction between the patterns. Overwrite & overlay combination is the same as that in the first embodiment, and a description thereof will not be repeated.

Figures 14A, 14B, 14C:
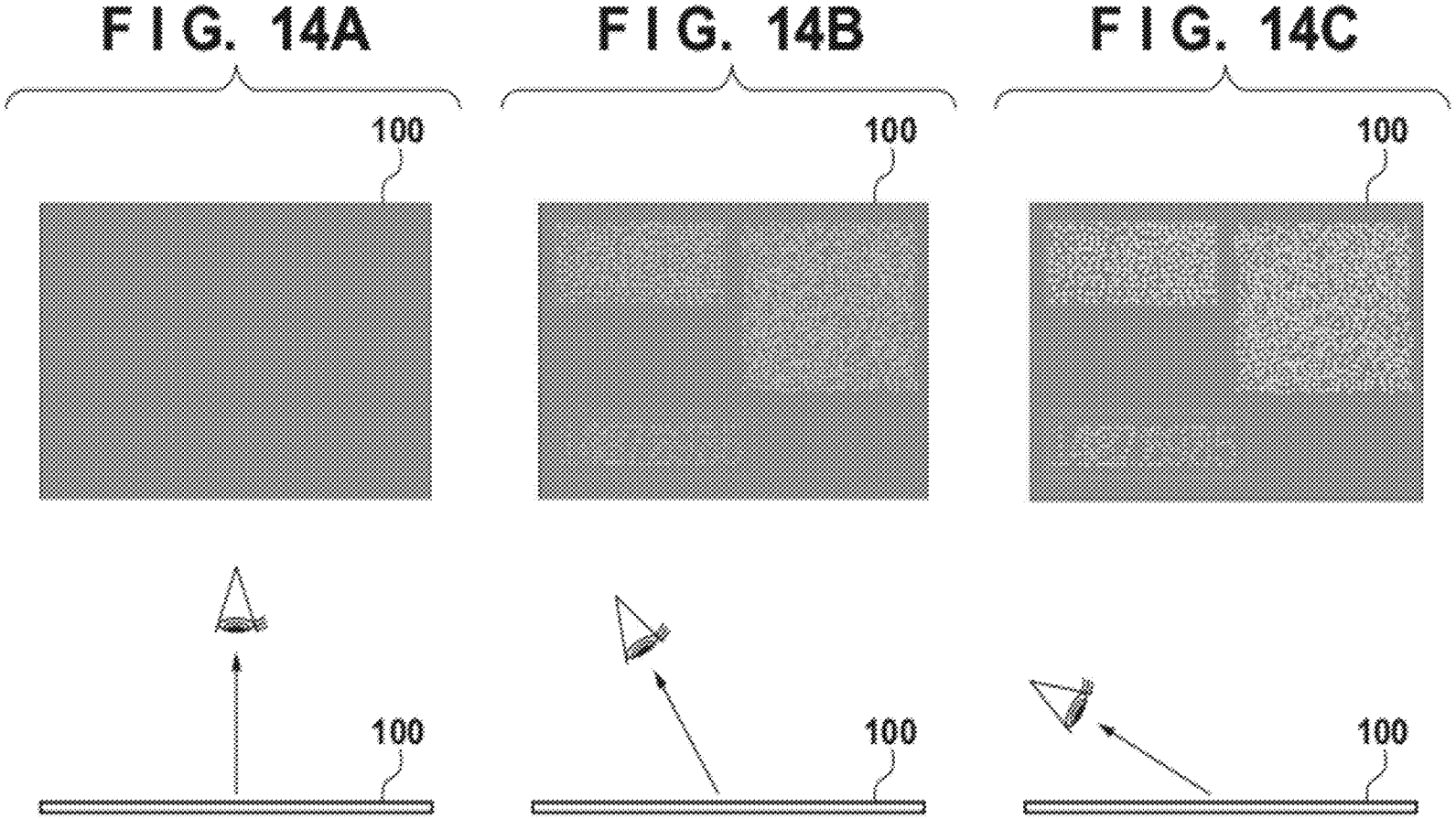
FIG. 14A to 14C are views visually showing states of a printing medium having undergone overcoat printing according to the third embodiment when viewed from different angles.

FIGS. 14A to 14C visually show states of a printing medium having undergone overcoat printing according to the third embodiment when viewed from different angles.

When the printing medium is viewed from the front, as shown in FIG. 14A, the surface state of the printed OC is hardly visually perceivable. When the printing medium is viewed slightly obliquely, as shown in FIG. 14B, the surface state of the printed OC is slightly visually perceivable.

When the printing medium is viewed further obliquely, as shown in FIG. 14C, the surface state of the printed OC is visually perceivable. At this time, however, hidden information printed on the printing medium is disguised by the disguise patterns, and it is therefore difficult to read it.

Figures 15A, 15B:
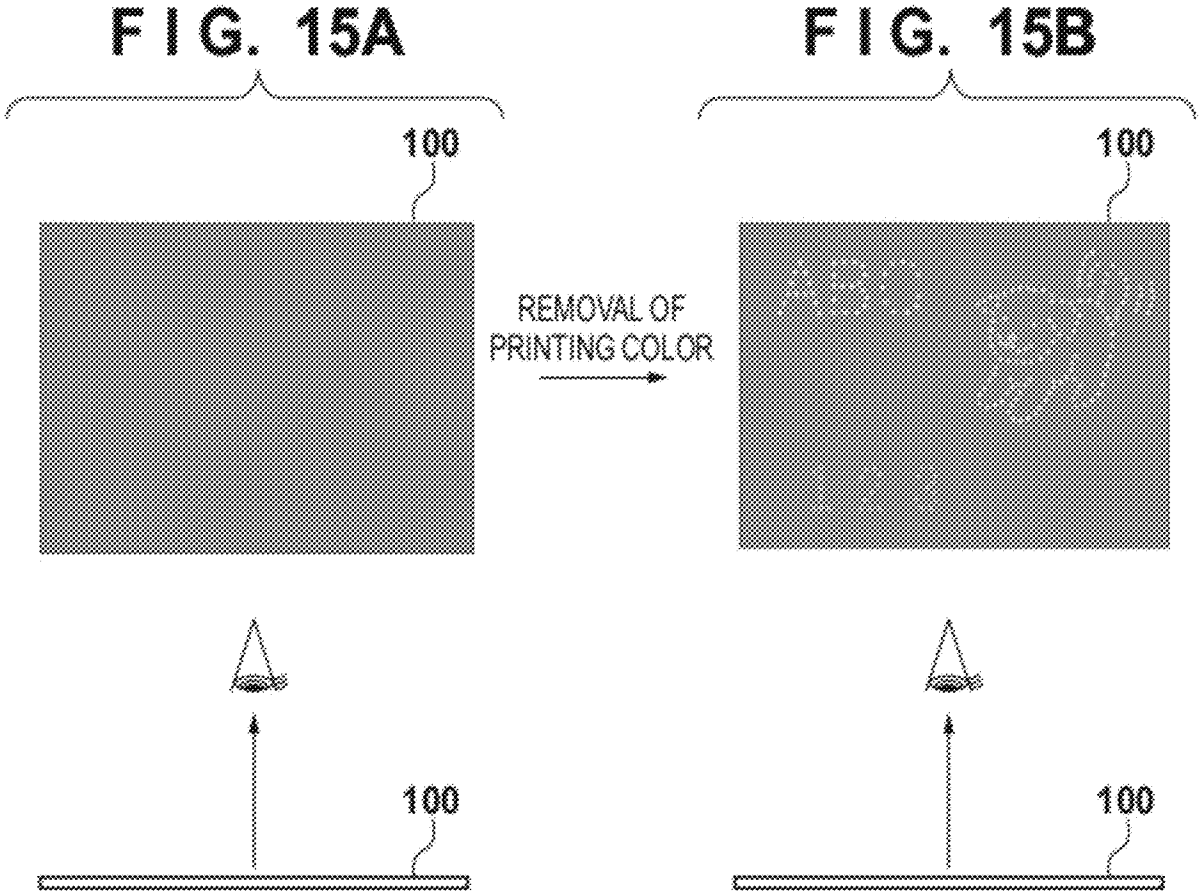
FIGS. 15A and 15B are views visually showing hidden information on a printing medium having undergone overcoat printing according to the third embodiment.

When the printing medium is viewed from the front in a state unchanged after printing, hidden information is hardly visually perceivable. A visual expression of this is as in FIG. 15A. When the arrangement portion of the hidden information pattern 1301 is rubbed with an eraser or the like after printing to remove the dye which forms a printing color at a portion corresponding to the hidden information pattern 1301, the hidden information can be read.

When the printing medium is viewed from the front in a state in which hidden information can be read, the hidden information pattern including the characters "ABC", numeral "123", and picture "animal" appears and the hidden information can be read. A visual expression of this is as in FIG. 15B.

According to the third embodiment, the image blocks of hidden information and a disguise pattern embedded in a printed image by overcoat printing can take arbitrary shapes such as a square, circle, and triangle.

Hidden information embedded on a printing medium by overcoat printing of the present invention is not limited to a character, and the present invention is applicable to even a numeral and picture. Also, the present invention is applicable to any two-dimensional patterns such as a sign, figure, and photograph in addition to a character, numeral, and picture as long as the two-dimensional pattern can be expressed by image blocks.

In the third embodiment, the hidden information numeral "123" is shielded using another numeral as a disguise pattern. That is, intentional use of a pattern which inhibits reading of hidden information as a disguise pattern enhances the disguise strength, making it more difficult to read the hidden information. The disguise pattern is not limited to a numeral, and the present invention is applicable to even a significant character, picture, sign, and photograph.

[Fourth Embodiment]

A thermal printer and overcoat printing method according to the fourth embodiment will be described. The block arrangement of the thermal printer which implements the fourth embodiment is the same as that in the above-described first embodiment, and a description thereof will not be repeated.

The first to third embodiments have described a method of setting the 1-dot printing tonal numbers of disguise patterns as follows and performing OC printing:

glossy disguise pattern: one arbitrary tonal number is set within the P(gloss) range as the 1-dot printing tonal number.

mat disguise pattern: one arbitrary tonal number is set within the P(mat) range as the 1-dot printing tonal number.

However, the 1-dot printing tonal number of a disguise pattern to which the present invention is applicable is not limited to set one arbitrary tonal number in each of P(gloss) and P(mat) (which will be called a disguise pattern dispersion count of 1). Two or more arbitrary tonal numbers can be set in each of P(gloss) and P(mat) (which will be called a disguise pattern dispersion count of 2).

The fourth embodiment will describe a method of setting a disguise pattern dispersion count of 2 as follows for the 1-dot printing tonal number of a disguise pattern and performing OC printing:

glossy disguise pattern: two arbitrary tonal numbers are set within the P(gloss) range as the 1-dot printing tonal number.

mat disguise pattern: two arbitrary tonal numbers are set within the P(mat) range as the 1-dot printing tonal number.

Note that print processing by the thermal printer according to the fourth embodiment is basically the same as that in FIG. 4 except that not one but two arbitrary tonal numbers are set in each of P(gloss) and P(mat) in steps S410 and S411:

step S410: glossy disguise pattern OC data are arranged.

step S411: mat disguise pattern OC data are arranged.

Disguise patterns for hidden information by OC print data processing by the thermal printer of the fourth embodiment and the print procedures will be explained with reference to FIGS. 16A to 16G.

Figure 16A:
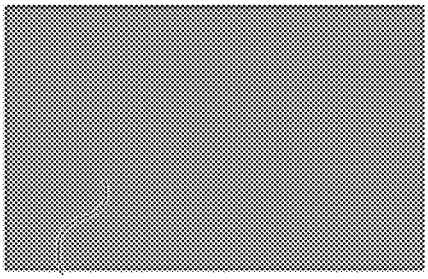
FIGS. 16A to 16G are views for explaining disguise patterns for hidden information and the print procedures according to the fourth embodiment.

FIG. 16A conceptually shows a state in which base OC data 1600 is arranged on the entire surface. The base OC data 1600 is transferred to cover the entire surface of a printing medium. Thus, the 1-dot printing tonal number is set to a constant tonal number Pbase for the number of dots corresponding to the entire surface of the printing medium. Pbase is a tonal number which falls within P(gloss): glossy OC tone range in FIG. 6 and improves OC transfer stability and surface glossiness in normal printing.

Figure 16B:
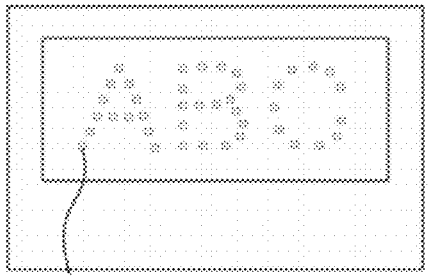

FIG. 16B conceptually shows a state in which hidden information pattern data is arranged. Square image blocks each formed from a plurality of pixels are set. The 1-dot printing tonal number is set to a tonal number which falls within P(zero): zero-OC tone range in FIG. 6 so that no OC is transferred onto a printing medium. The set image blocks are arranged as a hidden information pattern 1601. In the fourth embodiment, the hidden information indicates characters "ABC".

Figure 16C:
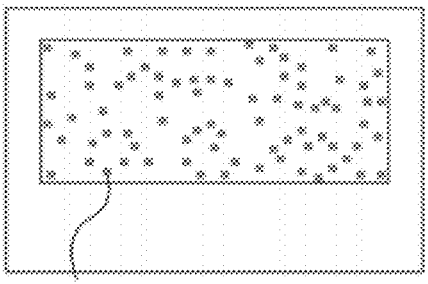

FIG. 16C conceptually shows a state in which the first glossy disguise pattern OC data is arranged. Square image blocks each formed from a plurality of pixels are set. The 1-dot printing tonal number is set to a tonal number which falls within P(gloss): glossy OC tone range in FIG. 6 and differs from Pbase. The set image blocks are arranged as a glossy disguise pattern 1 1602.

Figure 16D:
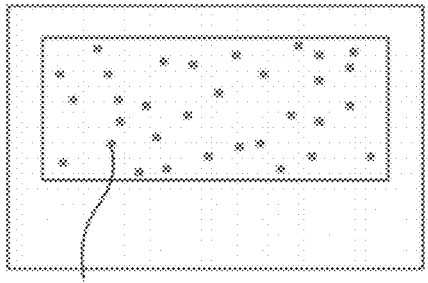

FIG. 16D conceptually shows a state in which the second glossy disguise pattern OC data is arranged. Square image blocks each formed from a plurality of pixels are set. The 1-dot printing tonal number is set to a tonal number which falls within P(gloss): glossy OC tone range in FIG. 6 and differs from Pbase and the tonal number of the glossy disguise pattern 1 1602. The set image blocks are arranged as a glossy disguise pattern 2 1603.

Figure 16E:
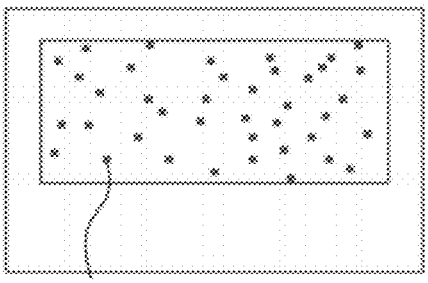

FIG. 16E conceptually shows a state in which the first mat disguise pattern OC data is arranged. Square image blocks each formed from a plurality of pixels are set. The 1-dot printing tonal number is set to a tonal number which falls within P(mat): mat OC tone range in FIG. 6 so that the OC is transferred onto a printing medium while the OC surface becomes less glossy. The set image blocks are arranged as a mat disguise pattern 1 1604.

Figure 16F:
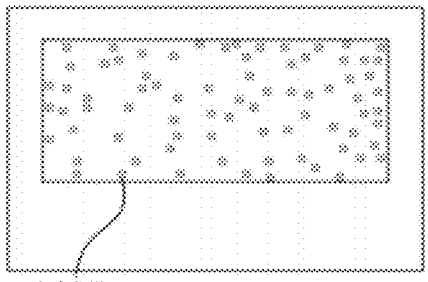

FIG. 16F conceptually shows a state in which the second mat disguise pattern OC data is arranged. Square image blocks each formed from a plurality of pixels are set. The 1-dot printing tonal number is set to a tonal number which falls within P(mat): mat OC tone range in FIG. 6 and differs from the tonal number of the mat disguise pattern 1 1604. The set image blocks are arranged as a mat disguise pattern 2 1605.

Figure 16G:
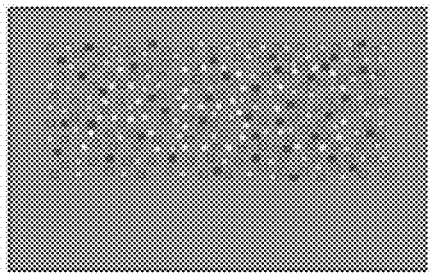

FIG. 16G conceptually shows a state in which the following OC image blocks are combined and arranged. To avoid the interference between OC data of the respective patterns, overwrite & overlay combination of pattern data is executed without performing addition/subtraction between the patterns. Overwrite & overlay combination is almost the same as that in the first embodiment, and a description thereof will not be repeated.

1600: base OC data

1601: hidden information pattern

1602: glossy disguise pattern 1 (first pattern)

1603: glossy disguise pattern 2 (second pattern)

1604: mat disguise pattern 1 (first pattern)

1605: mat disguise pattern 2 (second pattern)

According to the fourth embodiment, when embedding and printing hidden information at an arbitrary portion on a printing medium, the tonal numbers of respective OC image blocks of disguise pattern data are dispersed. Then, the respective OC patterns are printed at more different thicknesses and glossinesses. When the printing medium is viewed from various angles, the reflection state on the surface of a printing medium is further disturbed to increase the disguise strength of the disguise pattern. This makes reading of hidden information more difficult.

[Fifth Embodiment]

A thermal printer and overcoat printing method according to the fifth embodiment will be described. The block arrangement of the thermal printer which implements the fifth embodiment is the same as that in the above-described first embodiment, and a description thereof will not be repeated.

The first to fourth embodiments have described a method of forming each OC image block into an arbitrary shape made up of a plurality of pixels, setting different 1-dot printing tonal numbers for OC data of the respective patterns, and performing OC printing.

As a basic property of the thermal printer, OC transfer is controlled based on energy to be applied to the heater=1-dot printing tonal number. In an actual thermal printer, an OC print data shape and an OC transfer shape to be actually transferred may have an error. Main causes of the difference reside in the operation method of the thermal printer and the thermal characteristic of the thermal head.

The OC is transferred by selectively energizing heaters while conveying a printing medium in the sub scanning direction. At this time, energy to transfer the OC delays in the sub scanning direction owing to the rise/fall of heating in energization of heaters.

When a given heater is kept heated, heat accumulation tends to have a lasting effect in the sub scanning direction owing to self-heat accumulation of the heater. Also, heat generated by a given heater propagates to another heater adjacent in the main scanning direction, changing energy applied to the heater.

Considering this, in the fifth embodiment, an OC pixel correction method of correcting OC print data to reduce a shape error after OC printing that arises from the abovementioned phenomena will be explained with reference to FIGS. 17A to 17D and 18A to 18D.

Figure 17A:
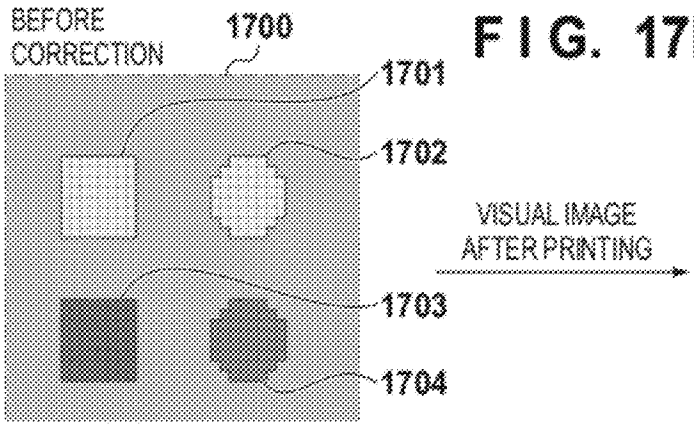
FIGS. 17A to 17D are views visually showing the pixel arrangement of glossy OC data before and after correction and states of a printing medium after printing according to the fifth embodiment.
Figure 17B:
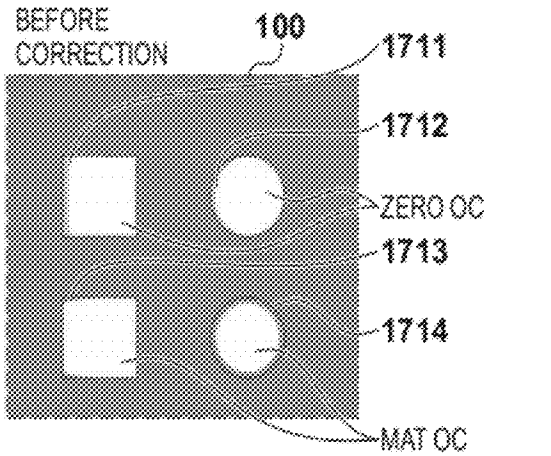
Figure 17C:
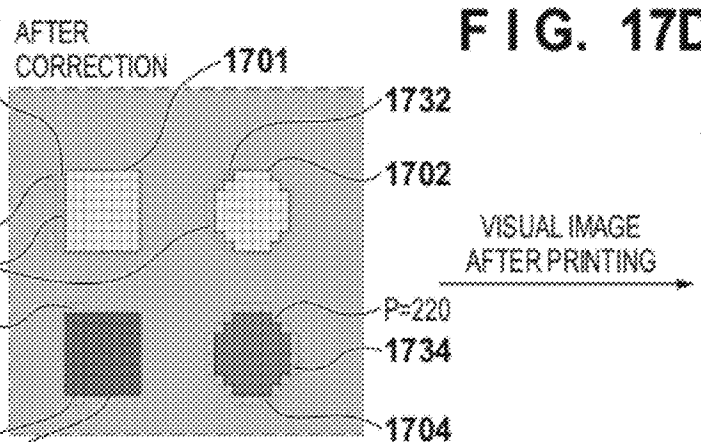

FIGS. 17A and 17C are views for explaining OC image blocks enlarged to the pixel level when a hidden information pattern is printed on base OC data set within P(gloss): glossy OC tone range.

Figure 17D:
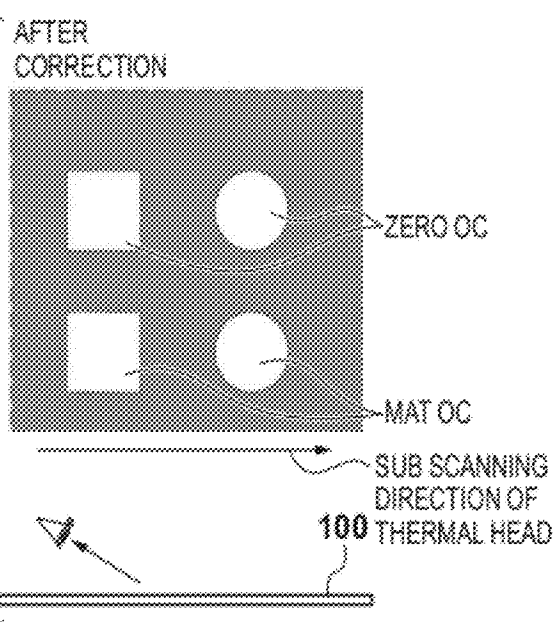

FIGS. 17B and 17D visually show printing medium states enlarged to the pixel level after executing OC printing in accordance with OC print data generated using the OC image blocks in FIGS. 17A and 17C.

Broken lines around the OC image blocks in FIGS. 17A and 17C indicate image block regions before OC pixel correction. Broken lines around regions corresponding to the OC image blocks in FIGS. 17B and 17D indicate the regions of ideal OC printing results which should be obtained by OC printing.

The OC image blocks in FIG. 17A are image blocks before OC pixel correction, and the OC image blocks in FIG. 17C are OC image blocks after OC pixel correction. For descriptive convenience, the shape of each OC image block and a 1-dot printing tonal number P are set as follows:

1-dot printing tonal number P: level of 0 to 255

1700: glossy base OC data P=170

1701: hidden information pattern 1 square image block (8×8 pixels) P=0

1702: hidden information pattern 2 circular image block (8×8 pixels) P=0

1703: mat disguise pattern 1 square image block (8×8 pixels) P=255

1704: mat disguise pattern 2 circular image block (8×8 pixels) P=230

FIG. 17B visually shows a printing medium state enlarged to the pixel level after executing OC printing in accordance with OC print data generated using the OC image blocks before OC pixel correction in FIG. 17A.

A zero-OC portion corresponding to the hidden information pattern 1 square image block 1701 is affected by the thermal characteristic of the thermal head. An OC overlapping portion 1711 is generated in a region where no OC should exist ideally.

A zero-OC portion corresponding to the hidden information pattern 2 circular image block 1702 is affected by the thermal characteristic of the thermal head. An OC overlapping portion 1712 is generated in a region where no OC should exist ideally.

A zero-OC portion corresponding to the mat disguise pattern 1 square image block 1703 is affected by the thermal characteristic of the thermal head. An OC gloss changed portion 1713 is generated in a region where a mat OC for P=255 should exist ideally.

A zero-OC portion corresponding to the mat disguise pattern 2 circular image block 1704 is affected by the thermal characteristic of the thermal head. An OC gloss changed portion 1714 is generated in a region where a mat OC for P=230 should exist ideally.

The generation of the OC overlapping portions 1711 and 1712 and the OC gloss changed portions 1713 and 1714 makes the respective OCs set as squares each of 8×8 pixels and circles each of 8×8 pixels differ in shape, size, and peripheral gloss.

If the differences in shape, size, and peripheral gloss between these OCs are visually perceived, the disguise strength of the disguise pattern decreases. FIG. 17C shows an example of performing OC pixel correction to reduce the differences in shape, size, and peripheral gloss between these OCs.

OC pixel correction values are set as follows for the OC image blocks before correction shown in FIG. 17A:

hidden information pattern 1 square image block 1701→correction pixels 1731 hidden information pattern 2 circular image block 1702→correction pixels 1732 mat disguise pattern 1 square image block 1703→correction pixels 1733 mat disguise pattern 2 circular image block 1704 →correction pixels 1734

The correction pixels 1731 include those for P=0 and 20, and are set on the front side of the hidden information pattern 1 square image block 1701 when viewed from the sub scanning direction of the thermal head. The correction pixels 1731 can decrease the influence of heat accumulation by the heaters of the thermal head, reducing the OC overlapping portion 1711.

The correction pixels 1732 are those for P =0, and are set on the front side of the hidden information pattern 2 circular image block 1702 when viewed from the sub scanning direction of the thermal head. The correction pixels 1732 can decrease the influence of heat accumulation by the heaters, reducing the OC overlapping portion 1712.

The correction pixels 1733 are those for P =230, and are set at the two ends of the mat disguise pattern 1 square image block 1703 in the sub scanning direction of the thermal head. The correction pixels 1733 can advance the heater driving timing to improve the rise of heating, and decrease the influence of heat of heaters adjacent in the main scanning direction on each other, reducing the OC gloss changed portion 1713.

The correction pixels 1734 are those for P =220, and are set entirely around the mat disguise pattern 2 circular image block 1704. The correction pixels 1734 can advance the heater driving timing to improve the rise of heating, and decrease the influence of heat of heaters adjacent in the main scanning direction on each other, reducing the OC gloss changed portion 1714.

FIG. 17D visually shows a printing medium state enlarged to the pixel level after executing OC printing in accordance with OC print data generated using the OC image blocks after OC pixel correction in FIG. 17C. The OC overlapping portions 1711 and 1712 and the OC gloss changed portions 1713 and 1714 which are generated in FIG. 17B are reduced. The respective OCs set as squares each of 8×8 pixels and circles each of 8×8 pixels seem visually uniform in shape, size, and peripheral gloss.

Figures 18A, 18B, 18C, 18D:
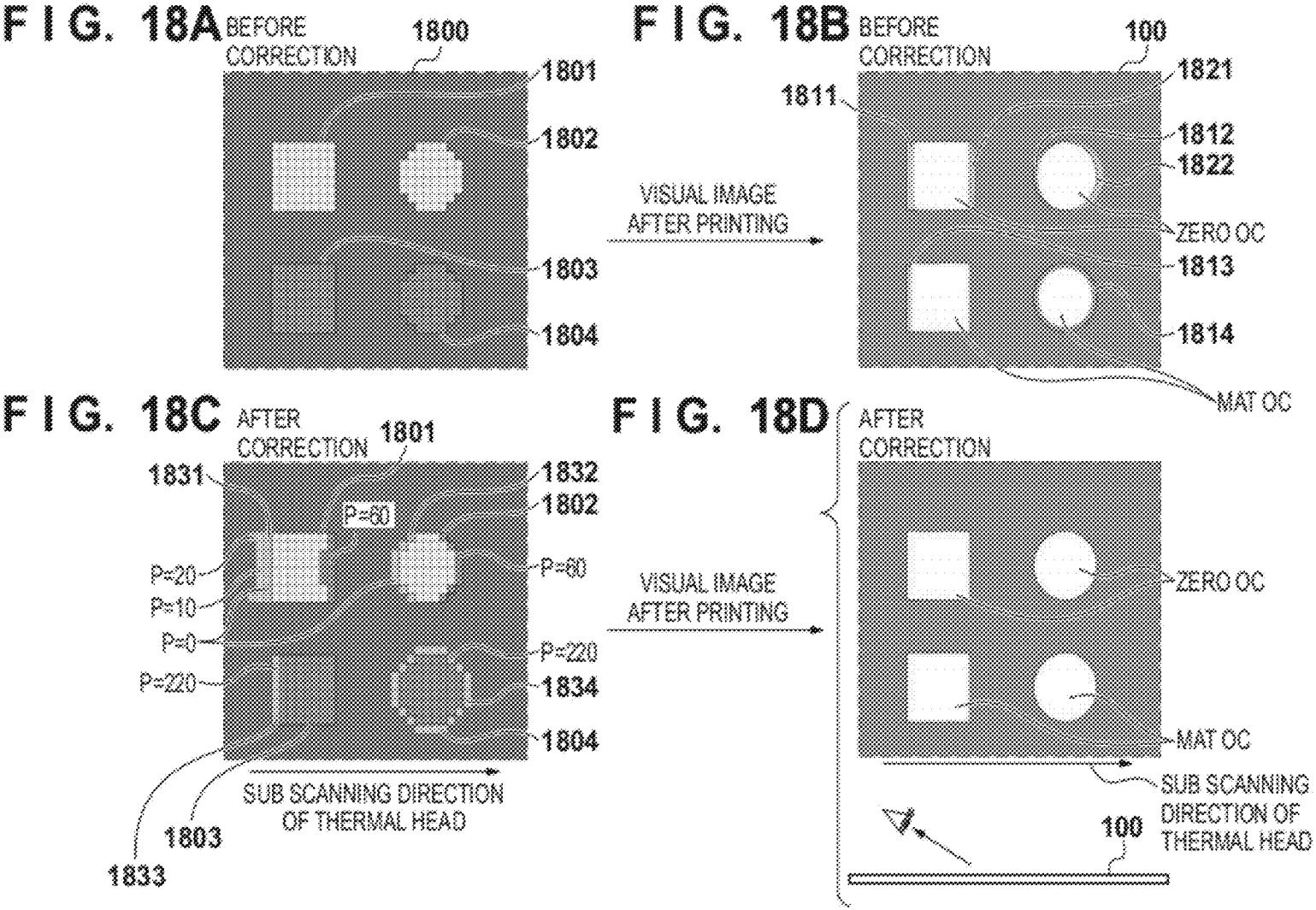
FIGS. 18A to 18D are views visually showing the pixel arrangement of mat OC data before and after correction and states of a printing medium after printing according to the fifth embodiment.

FIGS. 18A and 18C show OC image blocks enlarged to the pixel level when a hidden information pattern is printed on base OC data set within P(mat): mat OC tone range.

FIGS. 18B and 18D visually show printing medium states enlarged to the pixel level after executing OC printing in accordance with OC print data generated using the OC image blocks in FIGS. 18A and 18C.

Broken lines around the OC image blocks in FIGS. 18A and 18C indicate image block regions before OC pixel correction. Broken lines around regions corresponding to the OC image blocks in FIGS. 18B and 18D indicate the regions of ideal OC printing results which should be obtained by OC printing.

The OC image blocks in FIG. 18A are image blocks before OC pixel correction, and the OC image blocks in FIG. 18C are OC image blocks after OC pixel correction. For descriptive convenience, the shape of each OC image block and the 1-dot printing tonal number P are set as follows:

1-dot printing tonal number P: level of 0 to 255

1800: mat base OC data P=255

1801: hidden information pattern 1 square image block (8×8 pixels) P=0

1802: hidden information pattern 2 circular image block (8×8 pixels) P=0

1803: mat disguise pattern 1 square image block (8×8 pixels) P=230

1804: mat disguise pattern 2 circular image block (8×8 pixels) P=230

FIG. 18B visually shows a printing medium state enlarged to the pixel level after executing OC printing in accordance with OC print data generated using the OC image blocks before OC pixel correction in FIG. 18A.

A zero-OC portion corresponding to the hidden information pattern 1 square image block 1801 is affected by the thermal characteristic of the thermal head. An OC overlapping portion 1811 is therefore generated in a region where no OC should exist ideally. Further, an OC gloss changed portion 1821 is generated in a region where a mat base OC for P=255 should exist ideally.

A zero-OC portion corresponding to the hidden information pattern 2 circular image block 1802 is affected by the thermal characteristic of the thermal head. An OC overlapping portion 1812 is generated in a region where no OC should exist ideally. In addition, an OC gloss changed portion 1822 is generated in a region where a mat base OC for P=255 should exist ideally.

A zero-OC portion corresponding to the mat disguise pattern 1 square image block 1803 is affected by the thermal characteristic of the thermal head. An OC gloss changed portion 1813 is generated in a region where a mat OC for P=230 should exist ideally.

A zero-OC portion corresponding to the mat disguise pattern 2 circular image block 1804 is affected by the thermal characteristic of the thermal head. An OC gloss changed portion 1814 is generated in a region where a mat OC for P=230 should exist ideally.

The generation of the OC overlapping portions 1811 and 1812 and the OC gloss changed portions 1813, 1814, 1821, and 1822 makes the respective OCs set as squares each of 8×8 pixels and circles each of 8×8 pixels differ in shape, size, and peripheral gloss.

If the differences in shape, size, and peripheral gloss between these OCs are visually perceived, the disguise strength of the disguise pattern decreases. FIG. 18C shows an example of performing OC pixel correction to reduce the differences in shape, size, and peripheral gloss between these OCs.

OC pixel correction values are set as follows for the OC image blocks before correction shown in FIG. 18A:

hidden information pattern 1 square image block 1801→correction pixels 1831 hidden information pattern 2 circular image block 1802→correction pixels 1832 mat disguise pattern 1 square image block 1803→correction pixels 1833 mat disguise pattern 2 circular image block 1804 →correction pixels 1834

The correction pixels 1831 include those for P=0, 10, 20, and 60.

The correction pixels for P=0, 10, and 20 are set on the front side of the hidden information pattern 1 square image block 1801 when viewed from the sub scanning direction of the thermal head. The correction pixels for P=60 are set on the back side of the hidden information pattern 1 square image block 1801 when viewed from the sub scanning direction of the thermal head, to replace part of the hidden information pattern 1 square image block 1801.

Of the correction pixels 1831, the correction pixels for P=0, 10, and 20 decrease the influence of heat accumulation by the heaters, and the correction pixels for P=60 advance the heater driving timing to improve the rise of heating. As a result, the OC overlapping portion 1811 and OC gloss changed portion 1821 can be reduced.

The correction pixels 1832 are those for P =0 and 60.

The correction pixels for P=0 are set on the front side of the hidden information pattern 2 circular image block 1802 when viewed from the sub scanning direction of the thermal head. The correction pixels for P=60 are set on the back side of the hidden information pattern 2 circular image block 1802 when viewed from the sub scanning direction of the thermal head, to replace part of the hidden information pattern 2 circular image block 1802. Of the correction pixels 1832, the correction pixels for P=0 decrease the influence of heat accumulation by the heaters, and the correction pixels for P=60 advance the heater driving timing to improve the rise of heating. Accordingly, the OC overlapping portion 1812 and OC gloss changed portion 1822 can be reduced.

The correction pixels 1833 are those for P =220, and are set on the front side of the mat disguise pattern 1 square image block 1803 when viewed from the sub scanning direction of the thermal head, to replace part of the mat disguise pattern 1 square image block 1803. The correction pixels 1833 can decrease the influence of heat accumulation by the heaters, reducing the OC gloss changed portion 1813.

The correction pixels 1834 are those for P =220, and are set entirely around the mat disguise pattern 2 circular image block 1804. The correction pixels 1834 decrease the influence of heat accumulation by the heaters on the front side when viewed from the sub scanning direction of the thermal head, and advance the heater driving timing to improve the rise of heating on the back side when viewed from the sub scanning direction of the thermal head. As a consequence, the OC gloss changed portion 1814 can be reduced.

FIG. 18D visually shows a printing medium state enlarged to the pixel level after executing OC printing in accordance with OC print data generated using the OC image blocks after OC pixel correction in FIG. 18C. The OC overlapping portions 1811 and 1812 and the OC gloss changed portions 1813, 1814, 1821, and 1822 which are generated in FIG. 18B are reduced. The respective OCs set as squares each of 8×8 pixels and circles each of 8×8 pixels seem visually uniform in shape, size, and peripheral gloss.

The fifth embodiment has described a method of setting OC pixel correction values for OC image blocks and correcting OC print data to reduce a shape error after transferring OCs which are set at different tonal numbers and actually transferred.

The fifth embodiment has exemplified the OC image blocks of a zero-OC hidden information pattern and mat disguise pattern. However, the OC pixel correction method of the present invention is applicable to even a glossy disguise pattern.

The fifth embodiment has described OC image blocks as a square of 8×8 pixels and a circle of 8×8 pixels. However, the present invention is not limited to the number of pixels and the shapes described above. The present invention is applicable even when an OC image block has an arbitrary number of pixels and an arbitrary shape.

The arrangement of OC correction pixels and the 1-dot printing tonal number of the OC correction pixel described in the fifth embodiment are merely concepts. The arrangement of OC correction pixels and the 1-dot printing tonal number of the OC correction pixel are properly adjusted and changed in accordance with an image processing method in an image processing unit 204 and the characteristics of the thermal head serving as one component of a print engine 213.

In short, the present invention is applicable as long as OC correction pixels are set to reduce a shape error after OC transfer that is generated under the influence of the characteristics of the thermal head with respect to a 1-dot printing tonal number set for each OC image block.

[Other Embodiment]

In the above example, the image processing unit 204 performs OC print data processing according to each embodiment. Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium). In this case, the program and a storage medium storing the program constitute the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-279864, filed Dec. 15, 2010, which is hereby incorporated by reference herein in its entirety.

What is claimed is:

1. A thermal printer which transfers ink to a printing medium to print an image, comprising:

a transfer unit configured to transfer dye ink to the printing medium to print an image, and transfer an overcoat onto the entire image to protect the image; and a control unit configured to control transfer of the overcoat by said transfer unit, wherein said control unit forms a region where no overcoat is transferred to embed information in the overcoat, and forms, in the vicinity of the region where no overcoat is transferred, a pattern for hiding the information, to avoid visual perception of the information by a difference in gloss between the region where no overcoat is transferred and a region where the overcoat is transferred.

2. The thermal printer according to claim 1, wherein said transfer unit is a thermal head including a heater, said control unit controls transfer of the overcoat by controlling energy to be applied to the heater, and energy of an amount different from energy to another region where the overcoat is transferred is applied to a portion where the pattern is formed.

3. The thermal printer according to claim 1, wherein the pattern includes a glossy disguise pattern which are formed from a plurality of dots and transferred at a tonal number higher than a tonal number of the region where no overcoat is transferred, a mat disguise pattern which are formed from a plurality of dots and transferred at a tonal number lower than the tonal number of the glossy disguise pattern, the information to be hidden, and a mat line pattern which is transferred at a tonal number lower than the tonal number of the glossy disguise pattern and surrounds the glossy disguise pattern and the mat disguise pattern.

4. The thermal printer according to claim 3, wherein said control unit includes an image processing unit configured to generate overcoat transfer data by replacing a base tonal number for transferring the overcoat with a zero tonal number for forming the information to be hidden, the tonal number for transferring the glossy disguise pattern, the tonal number for transferring the mat disguise pattern, and the tonal number for transferring the mat line pattern, and said control unit controls transfer of the overcoat by said transfer unit in accordance with the overcoat transfer data generated by said image processing unit.

5. The thermal printer according to claim 3, wherein each of the glossy disguise pattern and the mat disguise pattern includes a first pattern and second pattern different from each other.

6. The thermal printer according to claim 1, wherein the pattern includes a glossy disguise pattern which is formed from a plurality of dots and transferred at a tonal number higher than a tonal number of the region where no overcoat is transferred, a mat disguise pattern which is formed from a plurality of dots and transferred at a tonal number higher than the tonal number of the glossy disguise pattern, the information to be hidden, and a mat base pattern which is transferred at a tonal number higher than the tonal number of the glossy disguise pattern and contains the glossy disguise pattern and the mat disguise pattern.

7. The thermal printer according to claim 6, wherein said control unit includes an image processing unit configured to generate overcoat transfer data by replacing a base tonal number for transferring the overcoat with a zero tonal number for forming the information to be hidden, the tonal number for transferring the glossy disguise pattern, the tonal number for transferring the mat disguise pattern, and the tonal number for transferring the mat base pattern, and said control unit controls transfer of the overcoat by said transfer unit in accordance with the overcoat transfer data generated by said image processing unit.

8. The thermal printer according to claim 1, wherein the information to be hidden is at least one of a character, a figure, a picture, a sign, and a photograph.

9. The thermal printer according to claim 1, wherein dots which form the information to be hidden by said transfer unit, and dots which form the pattern are identical in shape.

10. The thermal printer according to claim 9, wherein the dots which form the information to be hidden, and the dots which form the pattern are circular or square.

11. The thermal printer according to claim 10, wherein said control unit generates correction values for correcting a shape error after transfer of the dots, and corrects, based on the correction values, a base tonal number for transferring the overcoat, a zero tonal number for forming the information to be hidden, a tonal number for transferring the pattern.

12. The thermal printer according to claim 11, wherein the shape error after transfer of the dots is generated owing to one of influence of heat of adjacent heaters of the thermal head on each other, and heat accumulation of a heater of the thermal head in a scanning direction of the printing medium.

13. The thermal printer according to claim 11, wherein said control unit generates correction values to advance a driving timing of the heater of the thermal head.

14. The thermal printer according to claim 1, further comprising a switching unit configured to switch between a first mode in which information is embedded in the overcoat and a second mode in which no information is embedded in the overcoat, wherein in the first mode, said control unit controls to form, in the overcoat transferred onto the entire image, the region where no overcoat is transferred and a pattern for hiding the information, and transfer the overcoat, and in the second mode, controls transfer of the overcoat to transfer the overcoat onto the entire image.

15. A non-transitory computer-readable storage medium storing a program for causing a computer to function as each unit of a thermal printer defined in claim 1.

16. A thermal printer which transfers ink of an ink sheet to a printing medium to print an image, comprising:

a transfer unit configured to transfer dye ink to the printing medium to print an image, and transfer an overcoat onto the image to protect the image;

a control unit configured to control transfer of the overcoat by said transfer unit; and an input unit configured to input information, wherein said control unit forms information to be input by said input unit by forming, in the overcoat transferred onto the entire image, a non-transfer portion where no overcoat is transferred, and transfers the overcoat to form portions having different glosses at an overcoat transfer portion in the vicinity of the non-transfer portion.

17. A non-transitory computer-readable storage medium storing a program for causing a computer to function as each unit of a thermal printer defined in claim 16.

18. A method of transferring an overcoat onto an entire image to protect the image in a thermal printer which transfers dye ink to a printing medium to print an image, the method comprising:

a control step of controlling transfer of the overcoat, wherein in the control step, a region where no overcoat is transferred is formed to embed information in the overcoat, and a pattern for hiding the information is formed in the vicinity of the region where no overcoat is transferred, in order to avoid visual perception of the information by a difference in gloss between the region where no overcoat is transferred and a region where the overcoat is transferred.

19. A method of transferring an overcoat onto an image to protect the image in a thermal printer which transfers dye ink of an ink sheet to a printing medium to print an image, the method comprising:

an input step of inputting information; and a control step of controlling transfer of the overcoat, wherein in the control step, information to be input in the input step is formed by forming, in the overcoat transferred onto the entire image, a non-transfer portion where no overcoat is transferred, and the overcoat is transferred to form portions having different glosses at an overcoat transfer portion in the vicinity of the non-transfer portion.

* * * * *